US009938820B2

(12) United States Patent
Bonavides et al.

(10) Patent No.: US 9,938,820 B2
(45) Date of Patent: Apr. 10, 2018

(54) DETECTING GAS IN A WELLBORE FLUID

(71) Applicant: Saudi Arabian Oil Company, Dhahran (SA)

(72) Inventors: Clovis Satyro Bonavides, Dhahran (SA); Denis Philippe Schmitt, Dhahran (SA); Mohd Azizi Ibrahim, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 351 days.

(21) Appl. No.: 14/789,486

(22) Filed: Jul. 1, 2015

(65) Prior Publication Data

US 2017/0002646 A1 Jan. 5, 2017

(51) Int. Cl.

| | |
|---|---|
| ***E21B 47/01*** | (2012.01) |
| ***E21B 47/06*** | (2012.01) |
| ***E21B 47/10*** | (2012.01) |
| ***E21B 49/10*** | (2006.01) |

(52) U.S. Cl.

CPC ..... *E21B 47/06* (2013.01); *E21B 47/01* (2013.01); *E21B 47/101* (2013.01); *E21B 49/10* (2013.01)

(58) Field of Classification Search

CPC ..... E21B 47/06; E21B 47/01; E21B 47/10; E21B 49/00; E21B 2049/085

See application file for complete search history.

(56) References Cited

U.S. PATENT DOCUMENTS 3,776,032 A * 12/1973 Vogel ..... E21B 47/101 73/152.19
3,982,432 A * 9/1976 Hammond ..... E21B 21/08 702/9
4,565,086 A 1/1986 Orr, Jr.

(Continued)

FOREIGN PATENT DOCUMENTS

WO 2009142873 11/2009
WO WO2012128765 9/2012

(Continued)

OTHER PUBLICATIONS

International Search Report and Written Opinion issued in International Application No. PCT/US2015/059210 dated May 9, 2016; 15 pages.

(Continued)

*Primary Examiner* — Kenneth L Thompson
(74) *Attorney, Agent, or Firm* — Fish & Richardson P.C.

(57) ABSTRACT

A downhole gas detection tool includes a housing; a first test module that includes a first fluid test chamber operable to fluidly couple to an annulus of a wellbore to receive a first portion of a wellbore fluid, the first test module further including an acoustic fluid sensor to measure a fluid acoustic velocity and attenuation of the first portion of the wellbore fluid received in the first fluid test chamber, and a fluid resistivity sensor to measure a fluid resistivity of the first portion of the wellbore fluid received in the first fluid test chamber; and a second test module including a second fluid test chamber operable to fluidly couple to the annulus of the wellbore to receive a second portion of the wellbore fluid, and a pressure-temperature (PT) sensor to measure at least one of a pressure or a temperature of the second portion of the wellbore fluid.

35 Claims, 7 Drawing Sheets

(56) References Cited

U.S. PATENT DOCUMENTS

| | | | | |
|---|---|---|---|---|
| 5,201,220 | A | 4/1993 | Mullins et al. | |
| 5,661,236 | A | 8/1997 | Thompson | |
| 6,176,323 | B1 * | 1/2001 | Weirich | E21B 21/08 175/40 |
| 6,612,156 | B1 * | 9/2003 | Hakimuddin | B01F 3/1242 73/597 |
| 6,909,969 | B2 | 6/2005 | Calvert et al. | |
| 7,516,655 | B2 * | 4/2009 | DiFoggio | E21B 49/10 73/152.58 |
| 7,614,294 | B2 * | 11/2009 | Hegeman | E21B 43/25 73/152.39 |
| 7,617,052 | B2 | 11/2009 | Van Kuijk et al. | |
| 7,741,605 | B2 | 6/2010 | Gunn et al. | |
| 7,814,782 | B2 | 10/2010 | DiFoggio | |
| 8,151,878 | B2 * | 4/2012 | Georgi | E21B 49/083 166/264 |
| 8,283,174 | B2 * | 10/2012 | Van Hal | E21B 36/008 166/250.1 |
| 8,307,913 | B2 * | 11/2012 | Dolman | E21B 21/003 175/38 |
| 2003/0033866 | A1 | 2/2003 | Diakonov | |
| 2005/0241382 | A1 * | 11/2005 | Coenen | E21B 49/005 73/152.19 |
| 2008/0047337 | A1 | 2/2008 | Chemali et al. | |
| 2012/0089335 | A1 | 4/2012 | Kumar | |
| 2012/0137764 | A1 | 6/2012 | Lawrence et al. | |
| 2012/0192640 | A1 | 8/2012 | Minh et al. | |
| 2013/0263647 | A1 | 10/2013 | Barrett et al. | |
| 2014/0208840 | A1 | 7/2014 | Bright | |

FOREIGN PATENT DOCUMENTS

| | | |
|---|---|---|
| WO | WO2013101694 | 7/2013 |
| WO | WO2013126388 A1 | 8/2013 |

OTHER PUBLICATIONS

Tsai, C.R.; "MWD Sensors Improve Drilling Safety and Efficiency"; Petroleum Engineer International, vol. 64, No. 9; Sep. 1, 1992; pp. 59-68.

* cited by examiner

DETECTING GAS IN A WELLBORE FLUID

TECHNICAL FIELD

This disclosure relates to detecting gas in a wellbore fluid.

BACKGROUND

The presence of gas (for example, hydrocarbon gas) in drilling fluids may be indicative of potentially disastrous events with costly consequences. Early detection of gas in drilling fluids may prevent the onset and occurrence of such events and help increase drilling safety.

SUMMARY

In an example general implementation, a downhole gas detection tool includes a housing that includes a connection configured to couple the tool with a drilling string; a first test module at least partially enclosed within the housing that includes a first fluid test chamber operable to fluidly couple to an annulus of a wellbore to receive a first portion of a wellbore fluid, the first test module further including an acoustic fluid sensor to measure a fluid acoustic velocity and attenuation of the first portion of the wellbore fluid received in the first fluid test chamber, and a fluid resistivity sensor to measure a fluid resistivity of the first portion of the wellbore fluid received in the first fluid test chamber; and a second test module at least partially enclosed within the housing, the second test module including a second fluid test chamber operable to fluidly couple to the annulus of the wellbore to receive a second portion of the wellbore fluid, the second test module further including a pressure-temperature (PT) sensor to measure at least one of a pressure or a temperature of the second portion of the wellbore fluid received in the second fluid test chamber.

In a first aspect combinable with the general implementation, the first test module further includes a target for the acoustic fluid sensor positioned on a side of the first fluid test chamber opposite the acoustic fluid sensor.

In a second aspect combinable with any of the previous aspects, the target includes a portion of the fluid resistivity sensor.

In a third aspect combinable with any of the previous aspects, the first test module further includes a controllable valve in fluid communication with the first fluid test chamber to controllably receive the first portion of the wellbore fluid into the first fluid test chamber.

In a fourth aspect combinable with any of the previous aspects, the controllable valve is positioned in a fluid pathway that extends between the first fluid test chamber and the housing.

In a fifth aspect combinable with any of the previous aspects, the first test module further includes a plunger valve, controllable by a centrifugal switch, and positioned to fluidly couple and fluidly decouple the annulus and the controllable valve in the first test module.

In a sixth aspect combinable with any of the previous aspects, the centrifugal switch is operable to adjust the plunger valve between an open position to fluidly couple the annulus and the controllable valve and a closed position to fluidly decouple the annulus and the controllable valve based on rotation of the drilling string.

In a seventh aspect combinable with any of the previous aspects, the first test module further includes a pressure compensation module positioned in the housing adjacent the acoustic fluid sensor.

In an eighth aspect combinable with any of the previous aspects, the pressure compensation module includes a pressure compensation piston operable to adjust a differential pressure across the acoustic fluid sensor.

In a ninth aspect combinable with any of the previous aspects, the second test module further includes a controllable valve in fluid communication with the second fluid test chamber to controllably receive the second portion of the wellbore fluid into the second fluid test chamber.

In a tenth aspect combinable with any of the previous aspects, the controllable valve is positioned in a fluid pathway that extends between the second fluid test chamber and the housing.

In an eleventh aspect combinable with any of the previous aspects, the second test module further includes a plunger valve, controllable by a centrifugal switch, and positioned to fluidly couple and fluidly decouple the annulus and the controllable valve in the second test module.

In a twelfth aspect combinable with any of the previous aspects, the centrifugal switch is operable to adjust the plunger valve between an open position to fluidly couple the annulus and the controllable valve and a closed position to fluidly decouple the annulus and the controllable valve based on rotation of the drilling string.

In a thirteenth aspect combinable with any of the previous aspects, the second test module further includes a floating piston positioned in the second fluid test chamber and moveable within the second fluid test chamber based on a pressure of the second portion of the wellbore fluid.

In a fourteenth aspect combinable with any of the previous aspects, the second test module further includes a heater positioned to transfer heat to the second portion of the wellbore fluid.

In a fifteenth aspect combinable with any of the previous aspects, the second test module further includes a displacement measurement sensor positioned to measure a displacement distance of the floating piston based on the pressure of the second portion of the wellbore fluid.

In a sixteenth aspect combinable with any of the previous aspects, the wellbore fluid includes a drilling fluid.

In another example general implementation, a method for detecting gas in a wellbore fluid includes receiving a first portion of wellbore fluid in a first fluid test chamber of a first test module of the gas detection tool coupled within a downhole tool string in a wellbore; measuring a fluid resistivity of the first portion of wellbore fluid in the first fluid test chamber of the first test module; measuring a fluid acoustic velocity and fluid acoustic attenuation of the first portion of wellbore fluid in the first fluid test chamber of the first test module; receiving a second portion of wellbore fluid in a second fluid test chamber of a second test module of the gas detection tool; measuring at least one of a pressure or a temperature of the second portion of wellbore fluid in the second test chamber of the second test module; and determining a presence of a hydrocarbon gas in the wellbore fluid based on at least one of the measured fluid resistivity, fluid acoustic velocity, fluid acoustic attenuation, pressure, or temperature.

A first aspect combinable with the general implementation further includes drilling the wellbore with the downhole tool string.

In a second aspect combinable with any of the previous aspects, receiving the first portion of wellbore fluid in the first fluid test chamber of the first test module of the gas detection tool includes opening a control valve positioned in a fluid pathway that extends between the first fluid test chamber and an exterior housing of the gas detection tool;

and fluidly coupling an annulus of the wellbore with the first fluid test chamber based on opening the valve.

A third aspect combinable with any of the previous aspects further includes rotating the downhole tool string in the wellbore; based on the rotation, opening a plunger valve positioned in the fluid pathway with a centrifugal switch; and fluidly coupling the annulus of the wellbore with the control valve.

In a fourth aspect combinable with any of the previous aspects, receiving the second portion of wellbore fluid in the second fluid test chamber of the second test module of the gas detection tool includes opening a control valve positioned in a fluid pathway that extends between the second fluid test chamber and an exterior housing of the gas detection tool; fluidly coupling an annulus of the wellbore with the second fluid test chamber based on opening the control valve to receive the second portion of wellbore fluid in the second fluid test chamber; and closing the control valve to seal the second portion of the wellbore fluid in the second fluid test chamber.

A fifth aspect combinable with any of the previous aspects further includes rotating the downhole tool string in the wellbore; based on the rotation, opening a plunger valve positioned in the fluid pathway with a centrifugal switch; and fluidly coupling the annulus of the wellbore with the control valve.

A sixth aspect combinable with any of the previous aspects further includes at least one of transmitting the at least one measured fluid resistivity, fluid acoustic velocity, fluid acoustic attenuation, pressure, or temperature from the gas detection tool to a control system located on a terranean surface; or storing the at least one measured fluid resistivity, fluid acoustic velocity, fluid acoustic attenuation, pressure, or temperature in the gas detection tool.

In a seventh aspect combinable with any of the previous aspects, measuring at least one of the pressure or the temperature of the second portion of wellbore fluid in the second test chamber of the second test module includes measuring an initial temperature and an initial pressure of the second portion of the wellbore fluid; heating the second portion of the wellbore fluid a first specified temperature increase; and measuring, after the heating, a second temperature and a second pressure of the second portion of the wellbore fluid.

An eighth aspect combinable with any of the previous aspects further includes determining a ratio of a pressure differential to a temperature differential of the second portion of the wellbore fluid; and determining the presence of the hydrocarbon gas in the wellbore fluid based at least in part on the determined ratio.

In a ninth aspect combinable with any of the previous aspects, the pressure differential is a difference between the subsequent pressure and the initial pressure, and the temperature differential is a difference between the subsequent temperature and the initial temperature.

A tenth aspect combinable with any of the previous aspects further includes determining that the second portion of wellbore fluid is at a threshold temperature; and based on the determination, releasing the second portion of wellbore fluid from the second fluid test chamber to the annulus.

An eleventh aspect combinable with any of the previous aspects further includes, based on the determined presence of the hydrocarbon gas in the wellbore fluid, adjusting an operational parameter of the downhole tool string.

In a twelfth aspect combinable with any of the previous aspects, adjusting the operational parameter of the downhole tool string includes at least one of adjusting a rate of penetration of a drill bit of the downhole tool string; or adjusting a geo-direction of the drill bit of the downhole tool string.

In another example general implementation, a well system includes a drilling string that includes a downhole gas detection tool. The tool includes an acoustic fluid sensor positioned adjacent a first fluid chamber; a fluid resistivity sensor positioned adjacent the first fluid chamber; and a pressure-temperature (PT) positioned adjacent a second fluid chamber. The well system further includes a control system communicably coupled to the gas detection tool and operable to perform operations including operating a first valve during a drilling operation of the drilling string to circulate a drilling fluid into the first fluid chamber; operating a second valve during the drilling operation of the drilling string to circulate the drilling fluid into the second fluid chamber; receiving a measurement of at least one of a fluid acoustic velocity, fluid acoustic attenuation, a fluid resistivity, a fluid temperature, or a fluid pressure from the downhole gas detection tool; and determining a presence of a hydrocarbon gas in the drilling fluid based on the received measurement.

In a first aspect combinable with the general implementation, the control system is operable to perform further operations including, after receiving a measurement of the fluid temperature and the fluid pressure, operating a heater to heat the drilling fluid in the second fluid chamber; after heating, receiving another measurement of the fluid temperature and the fluid pressure; determining a ratio of a fluid temperature differential to a fluid pressure differential based on the measurements of the fluid temperature and the fluid pressure.

In a second aspect combinable with any of the previous aspects, the control system is operable to perform further operations including receiving a measurement of a displacement distance of a floating piston in the second fluid chamber based on an increase in the fluid pressure of the drilling fluid in the second fluid chamber; and determining the presence of the hydrocarbon gas in the drilling fluid based on the received measurement of the displacement distance.

In a third aspect combinable with any of the previous aspects, the control system is operable to perform further operations including, based on a determination that the pressure differential exceeds a threshold pressure differential, operating at least one pressure compensation piston to adjust a pressure of a pressure compensation chamber adjacent the acoustic fluid sensor to reduce the pressure differential.

In a fourth aspect combinable with any of the previous aspects, the control system is operable to perform further operations including operating the first and second control valves to release the drilling fluid from the first and second fluid chambers to the annulus.

Implementations of methods and systems for a gas detection tool according to the present disclosure may include one or more of the following features. For example, the gas detection tool may detect a presence of gas in a wellbore fluid as an early indicator of one or more dangerous situations in a drilling operation through one or more geologic formations. As another example, the tool may provide information about a compressibility of the wellbore fluid. As a further example, the tool may provide in situ gas detection in real time to characterize the dynamics of drilling fluid properties, leading to improvements in fluid design for increased borehole stability. The downhole gas detection tool may also allow an operator to "look-ahead" at wellbore fluid properties during drilling. Also, the tool may provide for typing by correlation with experimental fluid phase diagrams. As yet another example, the gas detection tool may deliver wellbore fluid properties information complementary to information commonly provided by gas mud logs, thereby leading to more depth-precise and accurate formation evaluation. In some cases, the gas detection tool may therefore improve a depth accuracy, a degree of confidence and a vertical resolution of the mud logs.

Implementations of methods and systems for a gas detection tool according to the present disclosure may include one or more of the following features. For example, the gas detection tool may be used in geo-steering to confirm or infirm a logging-while-drilling (LWD) tool presence in or near a gas cap. Further, the gas detection tool may measure wellbore fluid slowness for the quantitative processing or inversion of acoustic waveforms. Fluid slowness knowledge may be also used to convert time of flight measurements to distances when using acoustic calipers. As another example, the gas detection tool may provide for in-situ measurement of mud resistivity for the processing of formation electrical properties to help in the removal of a borehole contribution from other deeper reading electrical sensors. As yet another example, the gas detection tool may increase well site safety by, for example, providing early detection of the potential of gas blowouts, gas kicks, and similar dangerous occurrences.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes implementations of a gas detection tool. The gas detection tool, for example, may detect and quantify a presence of gas in wellbore fluids (for example, drilling mud and otherwise). The gas detection module may also determine a compressibility, an acoustic (for example, sonic) velocity, an acoustic (for example, sonic) attenuation, and a resistivity of the wellbore fluid. In some implementations, the gas detection tool, generally, includes an acoustic measurement module, a resistivity measurement module, and a pressure and temperature (PT) measurement module. In some aspects, the acoustic measurement module and the resistivity measurement module may be integrated by sharing a common fluid test chamber.

Figure 1:
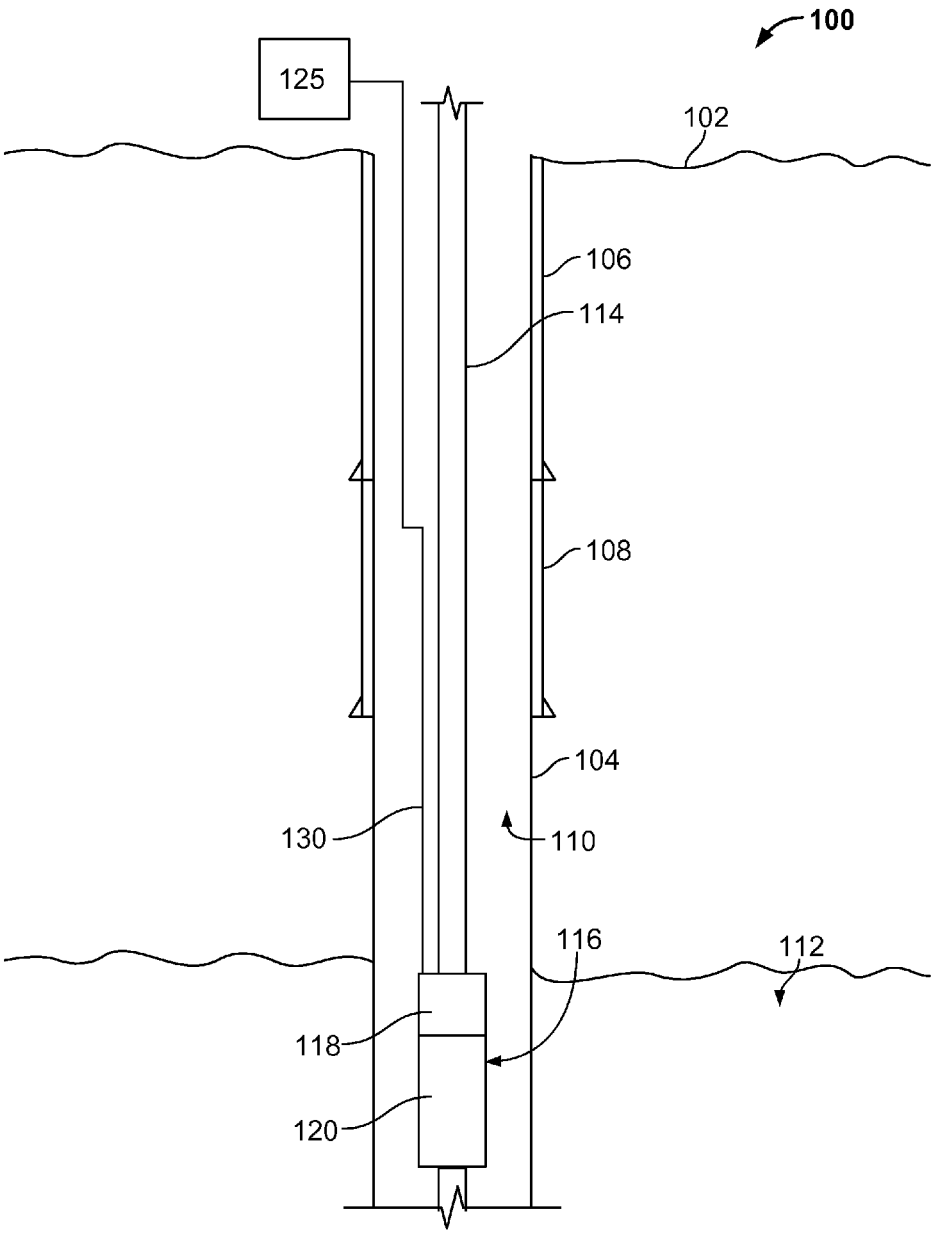
FIG. 1 illustrates a schematic diagram of a well system that includes a gas detection tool.

FIG. 1 illustrates a schematic diagram of a well system 100 that includes a gas detection tool 116. Generally, FIG. 1 illustrates a portion of one implementation of a wellbore system 100 according to the present disclosure in which the gas detection tool 116 may determine and quantify a presence of gas in a wellbore fluid 122 (for example, a drilling fluid). In this example, implementation, the gas detection tool 116 may be coupled to a tubular 114 (for example, a drilling string) to access a subterranean zone 112 that hold one or more hydrocarbon fluids. Although illustrated at an end of the tubular 114 in a wellbore 104, the gas detection tool 116 may be part of a larger tool string that includes, for example, a drilling assembly (for example, a bottom hole assembly) that includes a drill bit and one or more measurement instruments.

As illustrated in FIG. 1, the wellbore system 100 may access the subterranean zone 112 from a terranean surface 102. Although not shown here, a drilling assembly may be deployed on the terranean surface 102 and used to form the wellbore 104 extending from the terranean surface 1022 through one or more geological formations in the Earth. One or more subterranean formations, such as subterranean zone 112, are located under the terranean surface 102. One or more wellbore casings, such as a surface casing 106 and an intermediate casing 108, may be installed in at least a portion of the wellbore 104. As shown in this example, an annulus 110 is formed between the tubular 114 and the wellbore 104 and casings 106 and 108.

As illustrated, the wellbore 104 includes the surface casing 106, which extends from the terranean surface 102 shortly into the Earth. A portion of the wellbore 104 enclosed by the surface casing 106 may be a large diameter borehole. Downhole of the surface casing 106 may be the intermediate casing 108. The intermediate casing 108 may enclose a slightly smaller borehole and protect the wellbore 104 from intrusion of, for example, freshwater aquifers located near the terranean surface 102.

The wellbore 104 may extend vertically downward. Additionally, in some implementations, the wellbore 104 may be offset from vertical (for example, a slant or deviated wellbore). Even further, in some implementations, the wellbore 104 may be a stepped wellbore, such that a portion is drilled vertically downward and then curved to a substantially horizontal wellbore portion. Additional substantially vertical and horizontal wellbore portions may be added according to, for example, the type of terranean surface 102, the depth of one or more target subterranean formations, the depth of one or more productive subterranean formations, or other criteria.

In some implementations, a drilling assembly of well system 100 may be deployed on a body of water rather than the terranean surface 102. For instance, in some implementations, the terranean surface 102 may be an ocean, gulf, sea, or any other body of water under which hydrocarbon-bearing formations may be found. In short, reference to the terranean surface 102 includes both land and water surfaces and contemplates forming and developing one or more well systems 100 from either or both locations.

Generally, a drilling system of well system 100 may be any appropriate assembly used in association with a drilling rig used to form wellbores or boreholes in the Earth. The drilling assembly may use traditional techniques to form such wellbores, such as the wellbore 104, or may use nontraditional or novel techniques. In some implementations, the drilling assembly may use rotary drilling equipment to form such wellbores. Rotary drilling equipment is known and may consist of a drill string (for example, tubular 114) and a bottom hole assembly and bit. A rotary drilling rig is used to "trip" the drilling assembly upward and downward and/or to drive it rotationally as necessary.

Rotating equipment on such a rotary drilling rig may consist of components that serve to rotate a drill bit, which in turn forms the wellbore 102, deeper and deeper into the ground. Rotating equipment consists of a number of components, which contribute to transferring power from a prime mover to the drill bit itself. The prime mover supplies power to a rotary table, or top direct drive system, which in turn supplies rotational power to the tubular 114.

The circulating system of a rotary drilling operation may cool and lubricate the drill bit, removing the cuttings from the drill bit and the wellbore 104 (for example, through the annulus 110), and coat the walls of the wellbore 104 with a mud type cake. The circulating system consists of drilling fluid, which is circulated down through the tubular 114 and up through the annulus 122 throughout the drilling process. The wellbore fluid 122 may include the drilling fluid, a hydrocarbon fluid from the subterranean zone 112, or a mixture of both.

The gas detection tool 116, in this example implementation, includes a first test module 118 and a second test module 120. In some example implementations, the first test module 118 includes an acoustic measurement module and a resistivity measurement module. The second test module 120 may include a PT measurement module. Some implementations may have their location interchanged, with test module 118 located below test module 120. Although illustrated here as integrally coupled or contained within a single tool, that is, the gas detection tool 116, the first test module 118 and the second test module 120 may be separated but coupled (for example, threadingly) within a common tool string.

In an example implementation, the gas detection tool 116 may be installed relatively close to the drill bit, for example, to allow for early detection of gas in the wellbore fluid 122. In some examples, especially if gas travel velocity in the wellbore fluid 122 is high, the gas detection tool 116 can be installed at a distance between 10 feet and 100 feet from the drill bit and provide an early indication of gas presence in the fluid 122.

As illustrated in FIG. 1, the well system 100 includes a control system 125 communicably coupled through conveyance 130 to the gas detection tool 116. The control system 125, in some aspects, may be a micro-processor based control system, including input/output devices, memory that stores executable instructions, and one or more processors operable to execute the stored instructions. The microprocessor based control system may include one or more components (for example, memory and instructions accessible through a graphical user interface) that are off-premise, such as stored in one or more servers located remotely from the well system 100. In some aspects, the control system 125 may be electrical, mechanical, electro-mechanical, hydraulic, a combination thereof, or otherwise.

Figure 2A:
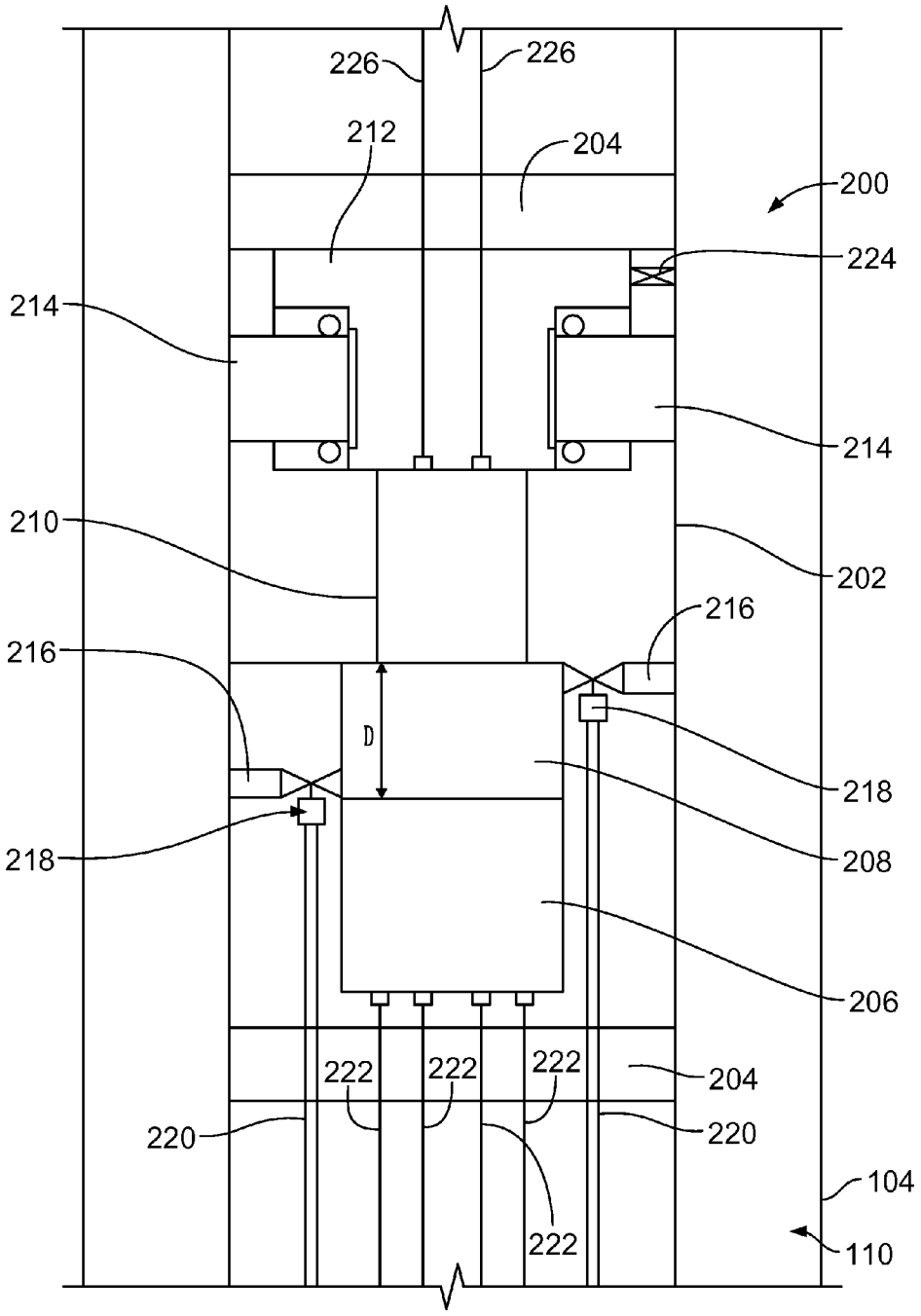
FIGS. 2A-2B illustrate schematic diagrams of example implementations of a first test module of a gas detection tool.
Figure 2B:
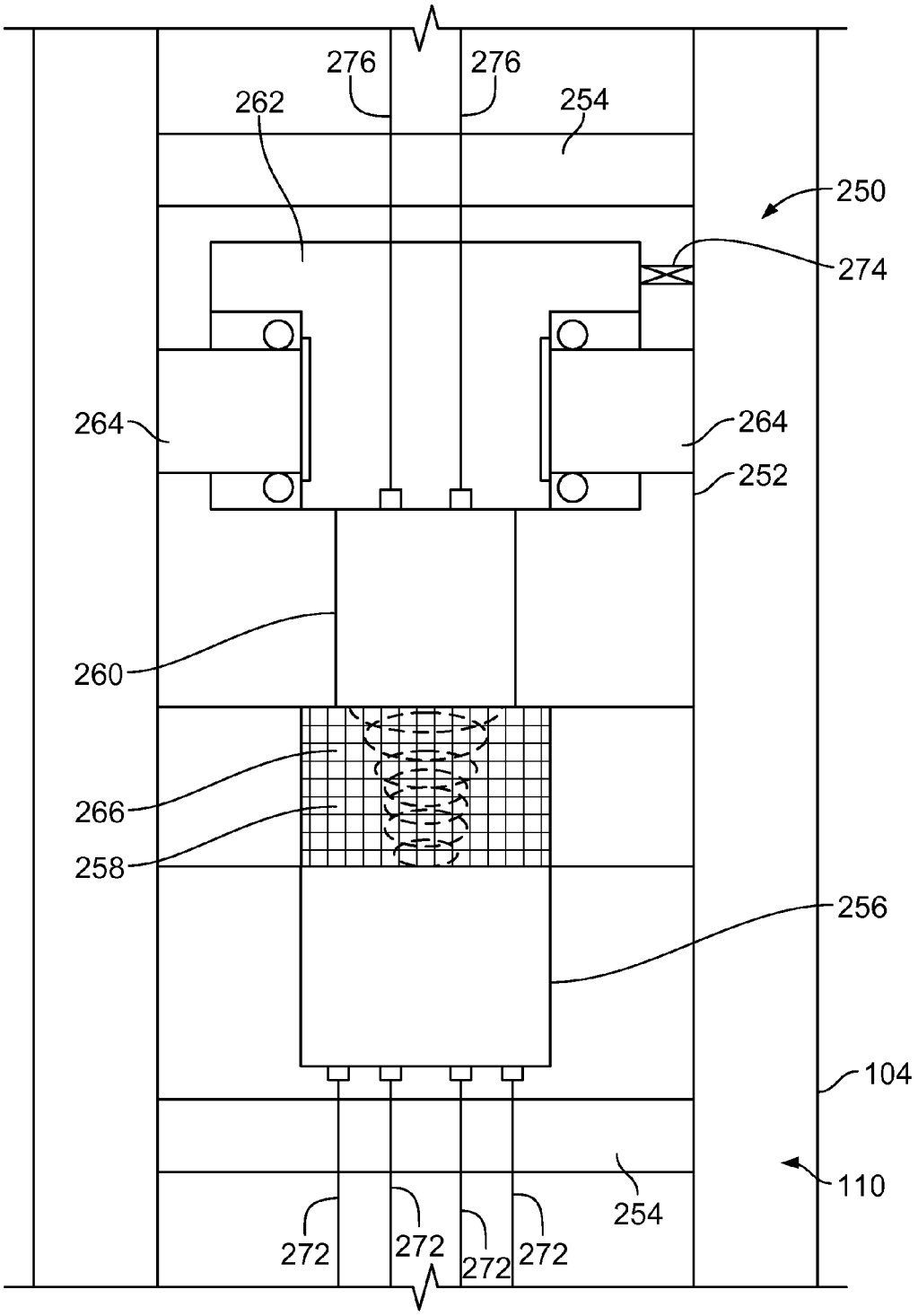

FIGS. 2A-2B illustrate schematic diagrams of example implementations of a first test module of a gas detection tool. FIG. 2A illustrates an example implementation of a first test module 200 that may be used in a gas detection tool (for example, gas detection tool 116). FIG. 2B illustrates an example implementation of a first test module 250 that may be used in a gas detection tool (for example, gas detection tool 116).

Turning to FIG. 2A, the example first test module 200, as shown here, is positioned in the wellbore 104, for example, as part of the gas detection tool 116. As illustrated, the first test module 200 includes a housing 202 that at least partially encloses a combination acoustic and electrical test cell. The example first test module 200 shown in FIG. 2A includes a fluid test chamber 208 adjacent in the housing 202 with an acoustic transducer 210 and a resistivity cell 206. The housing 202, in some aspects, may be coupled (for example, threadingly) to or with a downhole tool string, a wellbore tubular such as a drilling string, or another downhole tool (for example, a bottom hole assembly that includes a drill bit).

As illustrated, shock absorbers 204 are positioned at opposed axial ends of the first test module 200. The shock absorbers 204 may protect or help protect, for example, the acoustic transducer 210 and the resistivity cell 206, against substantial or excessive force or vibrations (for example, resonance) transmitted by the drill string (for example, tubular 114). Further, additional lateral shock absorbers (not represented in the figure) may also be used to reduce or mitigate effects of lateral force and vibration components on the acoustic transducer 210 and the resistivity cell 206.

As shown in this example first test module 200, the fluid test chamber 208 may be controllably coupled (for example, fluidly) to the annulus 110 with one or more fluid ports 216 and valves 218 (for example, electrically-controlled valves). For example, as shown, each valve 218 may be controllably modulated (for example, opened and closed) by commands transmitted through valve control wires 220. The valve control 220, in this example, includes a wired communication to, for example, a control system based on a terranean surface (for example, control system 125). Alternatively, commands to control the valve 218 may be pre-programmed in downhole-deployed electrical circuitry (for example, a control system part of or communicably coupled to the first test module 200) or may be sent from surface (using control system 125). The valve 218 may be opened to allow the wellbore fluid 122 to flow from the annulus 110 through the fluid port 216, and into the fluid test chamber 208.

In this example, two valves 218 (and two fluid ports 216) are included in the first test module 200. These controllable valves 218 control fluid communication between the annulus 110 and the test chamber 208 by allowing or disallowing the wellbore fluid 122 to pass through the fluid port 216 into the chamber 208. In this example, each port 218 and valve 218 combination can serve both as an inlet and as an outlet.

As shown, the acoustic module 210 and resistivity cell 206 are positioned within the housing 202 adjacent the test chamber 208 so that wellbore fluid 122 enclosed within the chamber 208. The acoustic module 210 (for example, a pulse echo acoustic transducer) includes associated power and signal amplification and conditioning circuitry (not shown in FIG. 2A) and works with a pressure compensation system made up of a pressure compensation chamber 212 and one or more pressure compensations pistons 214. Output from the acoustic module is provided through wires 226 that are connected to electrodes, which connect to top and bottom ceramic plates of the acoustic transducer.

Further, in this example, the resistivity cell 206 serves as a target onto which an acoustic signal from the acoustic module 210 may be directed. In some further aspects, the fluid test chamber 258 may include a wiping mechanism to clean a surface that separates the chamber 258 and the resistivity cell 256 that serves as the acoustic target. The wiping mechanism may include a small wiper driven by, for example, the wellbore fluid 122 being circulated through the fluid chamber 258, or by a rotating or reciprocating gear as further examples.

The example acoustic module 210 includes a narrow-banded pulse-echo sensor operating at a reasonably low frequency (for example, between 200 KHz and 350 KHz). In some aspects, the narrow-banded pulse-echo sensor operating at such frequencies may help overcome attenuative fluids and lower a noise power. The exact bandwidth choice may be chosen with such considerations in mind, helped by knowledge of the frequency spectrum characteristics of the drill string (for example, tubular 114). This may reduce the interference of possible resonance modes on the acoustic signal. Alternatively, a wide-banded pulse echo sensor may also be used for the acoustic module 210.

As another consideration, a distance, "D", between the acoustic module 210 and the target (here, resistivity cell 206) can be chosen considering an output power and a ringing noise characteristics of the acoustic transducer. In general, D can be between 1.25 inches and 3.0 inches, and in some aspects, is 2.0 inches.

In this example, the pressure compensation chamber 212 and the one or more pressure compensation pistons 214 may equalize, reduce, or help reduce a differential pressure across the acoustic module 208 to a desired amount, for example, within less than 30 pounds per square inch (psi). In some cases, acoustic transducers used in subsurface environments are composed of ceramic crystals that may be susceptible to mechanical failure (for example, "cracking') at a particular differential pressure. Some transducers, for example, can be damaged by a differential pressure as low as 100 psi. The pressure compensation chamber 212 may include one or more pressure sensors to measure the pressure differential across the acoustic module 208. In some implementations, if the pressure differential exceeds a threshold differential, the pistons 214 may be controlled (for example, by the control system 125) to operate to reduce the pressure differential.

To regulate a differential pressure applied to the acoustic module 210, the pressure compensation pistons 214 can move in and out freely within the limits mechanically set in their cavities to apply a pressure at one end of the acoustic module 210 that is the same as or close to an internal pressure of the fluid test chamber 208. In some aspects, the pressure internal to the fluid test chamber 208 is at or near pressure at a side of the pistons 214 nearest the annulus 110. Fill port 224 may be used for filling or purging the pressure compensation chamber 212. Although not labeled, O-ring seals (shown as circles) are used (as pressure barriers) to isolate a fluid in the pressure compensation chamber 212 from the wellbore fluid 122.

The illustrated resistivity cell 206 includes a differential resistivity cell that, for example, employs four wires 222 (for example, excitation and signals) and uses a sinusoidal single-frequency signal. In some aspects, the sinusoidal single-frequency signal lies between 1 KHz and 10 KHz.

In operation, at least one of the valves 218 may be controllably opened to allow a flow of wellbore fluid 122 into the fluid chamber 208. For example, one valve 218 may be opened to allow the flow (for example, circulated through rotary motion of the tubular 114) of wellbore fluid 122 into the fluid chamber 208, while the other valve 218 remains closed. The opened valve 218 may then be closed, sealing a volume of wellbore fluid 122 in the chamber 208. The ability to close or open access ports to chamber 208 can be used to reduce the probability of unwanted materials (for example, debris), such as rock cuttings, reaching the chamber 208 by limiting a time duration exposure to the wellbore fluid 122 The acoustic module 210 and resistivity cell 206 may then be operated to determine acoustic velocity, acoustic attenuation, and fluid resistivity properties of the sampled wellbore fluid 122. These measurements may then be stored for future retrieval (for example, in hardware circuity or memory contained in the first test module 200 or gas detection tool 116) or transmitted to the terranean surface 102. One of the valves 218 may then be opened to allow the sampled wellbore fluid 122 to flow to the annulus 110. These operations may be repeated upon command, periodically, or otherwise during a drilling or other wellbore operations.

Turning to FIG. 2B, the example first test module 250, as shown here, is positioned in the wellbore 104, for example, as part of the gas detection tool 116. As illustrated, the first test module 250 includes a housing 252 that at least partially encloses a combination acoustic and electrical test cell. The example first test module 250 shown in FIG. 2B includes a fluid test chamber 258 adjacent in the housing 252 with an acoustic transducer 260 and a resistivity cell 256.

As illustrated, shock absorbers 254 are positioned at opposed axial ends of the first test module 250. The shock absorbers 254 may protect or help protect, for example, the acoustic transducer 260 and the resistivity cell 256, against substantial or excessive force or vibrations (for example, resonance) transmitted by the drill string (for example, tubular 114).

As shown in this example first test module 250, the fluid test chamber 258 is open, for example, to the annulus 110 but covered with a filter screen 266. The filter 266 may be sized to prevent or substantially prevent debris within the wellbore fluid 122 from entering the fluid test chamber 258.

As shown, the acoustic module 260 and resistivity cell 256 are positioned within the housing 252 adjacent the test chamber 258 so that wellbore fluid 122 enclosed within the chamber 258. The acoustic module 260 (for example, a pulse echo acoustic transducer) includes associated power and signal amplification and conditioning circuitry (not shown in FIG. 2B) and works with a pressure compensation system made up of a pressure compensation chamber 262 and one or more pressure compensations pistons 264. Output from the acoustic module is provided through wires 276.

Further, in this example, the resistivity cell 256 serves as a target onto which an acoustic signal from the acoustic module 260 may be directed. In some further aspects, the fluid test chamber 258 may include a wiping mechanism to clean a surface that separates the chamber 258 and the resistivity cell 256 that serves as the acoustic target. The wiping mechanism may include a small wiper driven by, for example, the wellbore fluid 122 being circulated through the fluid chamber 258, or by a rotating or reciprocating gear as further examples.

The example acoustic module 260 includes a narrow-banded pulse-echo sensor operating at a reasonably low frequency (for example, between 250 KHz and 350 KHz). In some aspects, the narrow-banded pulse-echo sensor operating at such frequencies may help overcome attenuative fluids and lower a noise power. The exact bandwidth choice may be chosen with such considerations in mind, helped by knowledge of the frequency spectrum characteristics of the drill string (for example, tubular 114). This may reduce the interference of possible resonance modes on the acoustic signal.

As another consideration, a distance between the acoustic module 260 and the target (here, resistivity cell 256) can be chosen considering an output power and a ringing noise characteristics of the acoustic transducer. In general, this distance may be most likely between 1.25 inches and 3.0 inches, and in some aspects, is 2.0 inches.

In this example, the pressure compensation chamber 262 and the one or more pressure compensation pistons 264 may equalize, reduce, or help reduce a differential pressure across the acoustic module 258 to a desired amount, for example, within less than 30 pounds per square inch (psi). In some cases, acoustic transducers used in subsurface environments are composed of ceramic crystals that may be susceptible to mechanical failure (for example, "cracking') at a particular differential pressure. Some transducers, for example, can be damaged by a differential pressure as low as 100 psi.

To regulate a differential pressure applied to the acoustic module 260, the pressure compensation pistons 264 can move in and out freely within the limits mechanically set in their cavities to apply a pressure at one end of the acoustic module 260 that is the same as or close to an internal pressure of the fluid test chamber 258. In some aspects, the pressure internal to the fluid test chamber 258 is at or near pressure at a side of the pistons 264 nearest the annulus 110. Fill port 274 may be used for filling or purging the pressure compensation chamber 262. Although not labeled, O-ring seals (shown as circles) are used to isolate a fluid in the pressure compensation chamber 262 from the wellbore fluid 122.

The illustrated resistivity cell 256 includes a differential resistivity cell that, for example, employs four wires 272 (for example, excitation and signals) and uses a sinusoidal single-frequency signal. In some aspects, the sinusoidal single-frequency signal lies between 1 KHz and 10 KHz.

In operation, wellbore fluid 122 may be circulated into the chamber 258 during, for example, a drilling operation. The acoustic module 260 and resistivity cell 256 may then be operated to determine acoustic velocity, acoustic attenuation, and fluid resistivity properties of the sampled wellbore fluid 122. These measurements may then be stored for future retrieval (for example, in hardware circuity or non-volatile memory contained in the first test module 250 or gas detection tool 116) or transmitted to the terranean surface 102. As the wellbore fluid 122 may be continuously or periodically circulated through the filter 266 and into the chamber 258, the acoustic velocity, fluid acoustic attenuation, and fluid resistivity properties may be determined at multiple time instances during the drilling operation.

Figure 3:
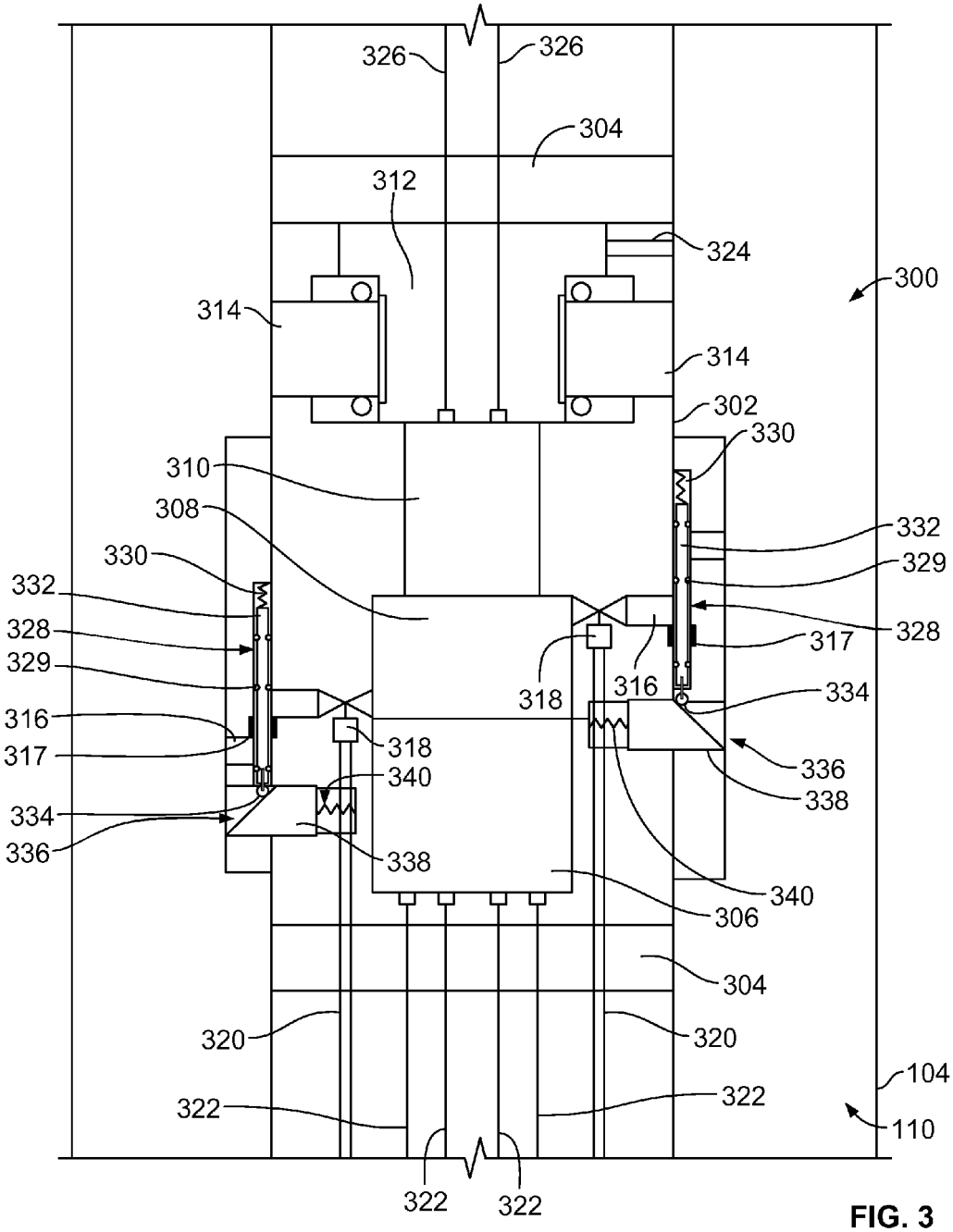
FIG. 3 illustrates a schematic diagram of another example implementation of a first test module of a gas detection tool.

FIG. 3 illustrates a schematic diagram of another example implementation of a first test module 300 of a gas detection tool. FIG. 3 illustrates an example implementation of a first test module 300 that may be used in a gas detection tool (for example, gas detection tool 116). The example first test module 300, as shown here, is positioned in the wellbore 104, for example, as part of the gas detection tool 116.

As illustrated, the first test module 300 includes a housing 302 that at least partially encloses a combination acoustic and electrical test cell. The example first test module 300 shown in FIG. 3 includes a fluid test chamber 308 adjacent in the housing 302 with an acoustic transducer 310 and a resistivity cell 306. The housing 302, in some aspects, may be coupled (for example, threadingly) to or with a downhole tool string, a wellbore tubular such as a drilling string, or another downhole tool (for example, a bottom hole assembly that includes a drill bit).

As illustrated, shock absorbers 304 are positioned at opposed axial ends of the first test module 300. The shock absorbers 304 may protect or help protect, for example, the acoustic transducer 310 and the resistivity cell 306, against substantial or excessive force or vibrations (for example, resonance) transmitted by the drill string (for example, tubular 114).

As shown in this example first test module 300, the fluid test chamber 308 may be controllably coupled (that is, fluidly) to the annulus 110 with one or more fluid ports 316 and valves 318. For example, as shown, each valve 318 may be controllably modulated (for example, opened and closed) by valve control 320. The valve control 320, in this example, includes a wired communication to, for example, a control system based on a terranean surface. Alternatively, commands to control the valve 118 may be pre-programmed in downhole-deployed electrical circuitry (for example, a control system part of or communicably coupled to the first test module 300). The valve 318 may be opened to allow the wellbore fluid 122 to flow from the annulus 110 through the fluid port 316, and into the fluid test chamber 308.

In this example, two valves 318 (and two fluid ports 316) are included in the first test module 300. These controllable valves 318 control fluid communication between the annulus 110 and the test chamber 308 by allowing or disallowing the wellbore fluid 122 to pass through the fluid port 316 into the chamber 308. In this example, each port 318 and valve 318 combination can serve both as an inlet and as an outlet.

As shown in this example implementation, each fluid port 316 may also be fluidly decoupled from the annulus 110 with a plunger valve assembly 328. In some aspects, the plunger valve assembly 328 may include a secondary mechanism, in addition to the controllable valve 318, for fluidly coupling the fluid test chamber 308 with the annulus 110. In other aspects, the plunger valve assembly 328 may include a primary mechanism for fluidly coupling the fluid test chamber 308 with the annulus 110, replacing the valve controls 320. Each valve 318, in such an implementation, may be manually or mechanically controlled, or may be in the form of an orifice. Further, each valve, in such an implementation, may be a one-way valve, such that one valve 318 is an inlet valve (for example, allowing wellbore fluid 122 to pass into the chamber 308 only) and one valve 318 is an outlet valve (for example, allowing wellbore fluid 122 to pass out of the chamber 308 only).

The illustrated plunger valve assembly 328 includes a plunger stem 332 positioned within the assembly 328 with a spring 330 adjacent one end of the stem 332 and a roller 334 adjacent another, opposite end of the stem 332. Controlling operation of the plunger valve assembly 328, in this example, is a centrifugal switch assembly 336 positioned beneath the plunger stem 332. The centrifugal switch assembly 336, as illustrated, includes a switch block 338 and a switch spring 340.

As shown, the acoustic module 310 and resistivity cell 306 are positioned within the housing 302 adjacent the test chamber 308 so that wellbore fluid 122 enclosed within the chamber 308. The acoustic module 310 (for example, a pulse echo acoustic transducer) includes associated power and signal amplification and conditioning circuitry (not shown in FIG. 3A) and works with a pressure compensation system made up of a pressure compensation chamber 312 and one or more pressure compensations pistons 314. Output from the acoustic module is provided through wires 326.

Further, in this example, the resistivity cell 306 serves as a target onto which an acoustic signal from the acoustic module 310 may be directed. In some further aspects, the fluid test chamber 358 may include a wiping mechanism to clean a surface that separates the chamber 358 and the resistivity cell 356 that serves as the acoustic target. The wiping mechanism may include a small wiper driven by, for example, the wellbore fluid 122 being circulated through the fluid chamber 358, or by a rotating or reciprocating gear as further examples.

The example acoustic module 310 includes a narrow-banded pulse-echo sensor operating at a reasonably low frequency (for example, between 200 KHz and 350 KHz). In some aspects, the narrow-banded pulse-echo sensor operating at such frequencies may help overcome attenuative fluids and lower a noise power. The exact bandwidth choice may be chosen with such considerations in mind, helped by knowledge of the frequency spectrum characteristics of the drill string (for example, tubular 114). This may reduce the interference of possible resonance modes on the acoustic signal.

As another consideration, a distance between the acoustic module 310 and the target (here, resistivity cell 306) can be chosen considering an output power and a ringing noise characteristics of the acoustic transducer. In general, this distance can be between 1.25 inches and 3.0 inches, and in some aspects, is 2.0 inches.

In this example, the pressure compensation chamber 312 and the one or more pressure compensation pistons 314 may adjust (for example, reduce) or help adjust a differential pressure across the acoustic module 308 to a desired amount, for example, within less than 30 pounds per square inch (psi). In some cases, acoustic transducers used in subsurface environments are composed of ceramic crystals that may be susceptible to mechanical failure (for example, "cracking') at a particular differential pressure. Some transducers, for example, can be damaged by a differential pressure as low as 100 psi.

To regulate a differential pressure applied to the acoustic module 310, the pressure compensation pistons 314 may be controllably adjusted to apply a pressure at one end of the acoustic module 310 that is the same as or close to an internal pressure of the fluid test chamber 308. In some aspects, the pressure internal to the fluid test chamber 308 is at or near pressure at a side of the pistons 314 nearest the annulus 110. Fill port 324 may be used for filling or purging the pressure compensation chamber 312. Although not labeled, O-ring seals (shown as circles) are used to isolate a fluid in the pressure compensation chamber 312 from the wellbore fluid 122.

The illustrated resistivity cell 306 includes a differential resistivity cell that, for example, employs four wires 322 (for example, excitation and signals) connected to electrodes and uses a sinusoidal single-frequency signal. In some aspects, the sinusoidal single-frequency signal lies between 1 KHz and 10 KHz. In an alternative implementation, a centrifugal switch may be employed to improve the reliability of the equipment by preventing the access of fluids into the measuring apparatus when the drill string is not being rotated and the well fluid is not being circulated, thereby reducing the exposure of the equipment to unwanted debris that might accumulate inside the fluid chamber 308.

In an example operation, the centrifugal switch assemblies 336 may operate the plunger stem assemblies 328 to fluidly couple the fluid test chamber 308 to the annulus 110 during, for example, a drilling operation. For example, so-called centrifugal force acts, due to rotation of the drill string (for example, tubular 114), on the switch blocks 338, causing the blocks 338 to move radially away from the tool body against resistance of the switch springs 340 that urge the blocks 338 back toward the center of the tool. As the switch blocks 338 move radially outward, the rollers 334 are moved across a ramped surface of the blocks 338, thereby moving the plunger stems 332 to move up. This upward movement of the stems 332, as well as radially outward movement of the switch blocks 338, is also opposed by the springs 330, which urge the plunger stems 332 down.

As the switch blocks 338 reach an end of travel in the radial outward direction, the plunger stems 332 reach a position where a plunger center o-ring 329 no longer seats against a sealing surface 317, thereby creating a free path for wellbore fluid 122 to reach the fluid test chamber 308 through valves 318. In this particular implementation, the wellbore fluid 122 can flow into the test chamber 308 through an open space around the plunger stems 332. Should the valves 318 be controllable valves, valve control 320 may be initiated to open the valves 318 as well. The centrifugal switch may also be configured in such a way that the seal between the wellbore fluid ports 316 and valves 318 occurs when the drill string is rotating.

The acoustic module 310 and resistivity cell 306 may then be operated to determine acoustic velocity, fluid acoustic attenuation, and fluid resistivity properties of the sampled wellbore fluid 122. These measurements may then be stored for future retrieval (for example, in hardware circuity or memory contained in the first test module 300 or gas detection tool 116) or transmitted to the terranean surface 102. These operations may be executed upon command, periodically, event-driven or otherwise during a drilling or other wellbore operations.

Figure 4:
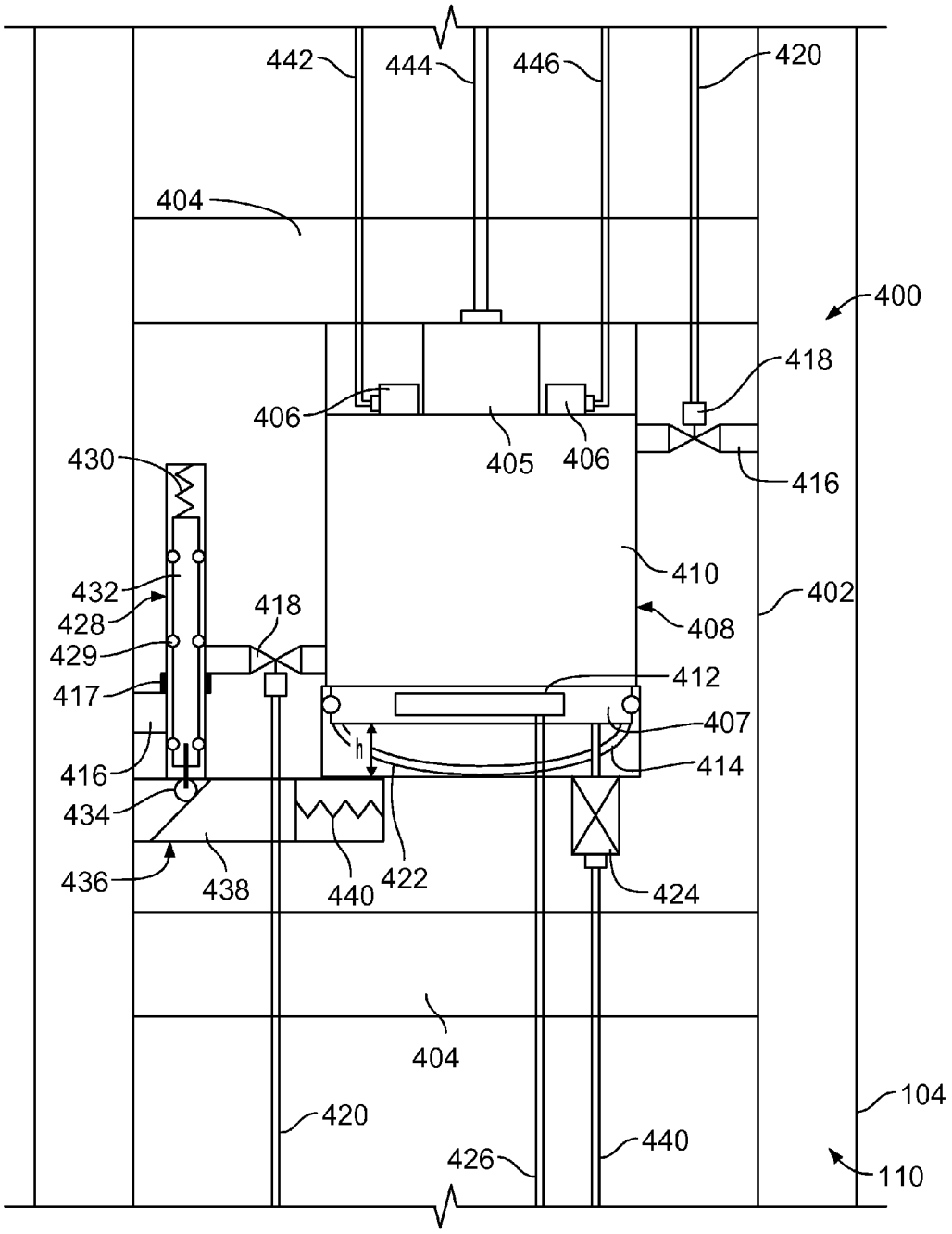
FIG. 4 illustrates a schematic diagram of an example implementation of a second test module of a gas detection tool.

FIG. 4 illustrates a schematic diagram of an example implementation of a second test module 400 of a gas detection tool (for example, gas detection tool 116). The example second test module 400, as shown here, is positioned in the wellbore 104, for example, as part of the gas detection tool 116.

As illustrated, the second test module 400 includes a housing 402 that at least partially encloses a PT cell 408. The housing 402, in some aspects, may be coupled (for example, threadingly) to or with a downhole tool string, a wellbore tubular such as a drilling string, or another downhole tool (for example, a bottom hole assembly that includes a drill bit).

As illustrated, shock absorbers 404 are positioned at opposed axial ends of the second test module 400. The shock absorbers 404 may protect or help protect, for example, the PT cell 408 against substantial or excessive force or vibrations (for example, resonance) transmitted by the drill string (for example, tubular 114).

The PT cell 408, in this example, measures a pressure or a temperature, or both, of the wellbore fluid 122 circulating through the annulus 110. For example, by determination of the pressure, temperature, or both in the wellbore fluid 122, gas in the wellbore fluid may be detected during a wellbore operation (for example, a drilling operation) using the principle of gas expansion. The PT cell 408, in this example, includes a test chamber 410 that may be selectively or controllably placed in fluid (for example, hydraulic) communication with the annulus 110 with, at least in part, the valves 418. The PT cell 408 also includes a pressure transducer 405 adjacent the test chamber 410, one or more temperature transducers 406, and a heating element 412 with an associated spring 414 (for example, a leaf spring as shown). In this example implementation, a linear displacement transducer 424 is also included for obtaining additional information about the wellbore fluid 122.

The PT cell 408 provides for iso-volumetric testing of the wellbore fluid 122 for temperature, pressure, or both, to determine or help determine a presence of gas in the fluid 122. For example, the temperature of the fluid 122 in the test chamber 410 may be increased (for example, by the heater 412) to a desired level and a resulting pressure of the wellbore fluid 122 is recorded (for example, by the pressure transducer 405).

As shown, the heating element 412 is a part of a floating piston that separates the test chamber 410 from the spring 414. As the temperature of the wellbore fluid 122 is raised by activating heater 412, the fluid 122 in the test chamber 410 expands, causing the floating piston of the heating element 412 to be urged downward against the spring 414. The spring 414 is positioned to resist downward movement of the floating piston. As illustrated in this example, the floating piston can move a distance, "h", at which point a volume of the test chamber 410 reaches a maximum. At the maximum volume, an internal pressure of the test chamber 410 may increase if gas is present in the wellbore fluid 122 in the test chamber 408, either free or in solution. This internal pressure may be measured by the pressure transducer 405 and output through pressure signal 444.

The heating element 412 (that includes or is part of the floating piston) is controlled in this example implementation with heater control 426. The heater control 426 may be communicably coupled to, for example, a controller or other control circuitry as part of the gas detection tool 116, a control system at the terranean surface 102, or otherwise. Further, as shown, the linear displacement transducer 424 (may) provides a displacement signal 440 that represents a distance (for example, up to "h") moved by the floating piston during expansion of the wellbore fluid 122 in the test chamber 408.

As shown in this example second test module 400, the fluid test chamber 408 may be controllably coupled (for example, fluidly) to the annulus 110 with one or more fluid ports 416 and valves 418. For example, as shown, each valve 418 may be controllably modulated (for example, opened and closed) by valve control 420. The valve control 420, in this example, includes a wired communication to, for example, a control system based on a terranean surface. Alternatively, commands to control the valve 118 may be pre-programmed in downhole-deployed electrical circuitry (for example, a control system part of or communicably coupled to the second test module 400). The valve 418 may be opened to allow the wellbore fluid 122 to flow from the annulus 110 through the fluid port 416, and into the fluid test chamber 408.

In this example, two valves 418 (and two fluid ports 416) are included in the second test module 400. These controllable valves 418 control fluid communication between the annulus 110 and the test chamber 408 by allowing or disallowing the wellbore fluid 122 to pass through the fluid port 416 into the chamber 408. In this example, each port 418 and valve 418 combination can serve both as an inlet and as an outlet.

As shown in this example implementation, one of the fluid ports 416 may also be fluidly decoupled from the annulus 110 with a plunger valve assembly 428. In alternative implementations, both fluid ports 416 may be fluidly decoupled with a plunger valve assembly 428. In some aspects, the plunger valve assembly 428 may include a secondary mechanism, in addition to the controllable valve 418, for fluidly coupling the fluid test chamber 408 with the annulus 110. In other aspects, the plunger valve assembly 428 may include a primary mechanism for fluidly coupling the fluid test chamber 408 with the annulus 110, replacing the valve controls 420. Each valve 418, in such an implementation, may be manually or mechanically controlled, or may be in the form of an orifice. Further, each valve, in such an implementation, may be a one-way valve, such that one valve 418 is an inlet valve (for example, allowing wellbore fluid 122 to pass into the chamber 408 only) and one valve 418 is an outlet valve (for example, allowing wellbore fluid 122 to pass out of the chamber 408 only).

The illustrated plunger valve assembly 428 includes a plunger stem 432 positioned within the assembly 428 with a spring 430 adjacent one end of the stem 432 and a roller 434 adjacent another, opposite end of the stem 432. Controlling operation of the plunger valve assembly 428, in this example, is a centrifugal switch assembly 436 positioned beneath the plunger stem 432. The centrifugal switch assembly 436, as illustrated, includes a switch block 438 and a switch spring 440.

In an example operation, the centrifugal switch assemblies 436 may operate the plunger stem assemblies 428 to fluidly couple the fluid test chamber 408 to the annulus 110 during, for example, a drilling operation. For example, so-called centrifugal force acts, due to rotation of the drill string (for example, tubular 114), on the switch blocks 438, causing the blocks 438 to move radially away from the fluid chamber 408 (that is, against resistance of the switch springs 440 urging the blocks 438 toward the fluid test chamber 408). As the switch blocks 438 move radially outward, the rollers 434 are moved across a ramped surface of the blocks 438, thereby moving the plunger stems 432 to move up. This upward movement of the stems 432, as well as radially outward movement of the switch blocks 438, is also opposed by the springs 430, which urge the plunger stems 432 down.

As the switch block 438 reaches an end of travel in the radial outward direction, the plunger stem 432 reaches a position where a plunger center o-ring 429 no longer seats against a sealing surface 417, thereby creating a free path for wellbore fluid 122 to reach the fluid test chamber 408 through valve 418. In this particular implementation, the wellbore fluid 122 can flow into the test chamber 408 through an open space around the plunger stems 432. Should the valves 418 be controllable valves, valve control 420 may be initiated to open the valves 418 as well.

The temperature of the wellbore fluid 122 is then increased by operation of the heater element 412. In some examples, the temperature of the fluid 122 is increased by up to 100° F. by applying electrical power to the heating element 412 through the heater power 426. In the implementation shown in FIG. 4, the heating element 412 is part of the floating piston 407.

Temperature readings of the wellbore fluid 122 may be taken by the one or more temperature sensors 406 and provided, for example to control equipment, by corresponding temperature signals 442 and 446. The temperature measurements provided by the sensors 406 may provide information about the pressure-volume-temperature (PVT) behavior (for example, according to Boyle's law) of the wellbore fluid 122. For example, the temperature readings may be part of a feedback control loop that sets the temperature increase by the heating element 412, along with pressure measurements taken by the pressure transducer 405. Further, wellbore fluid volume in the test chamber 408 may be measured based on movement of the floating piston 407 and a resulting displacement measured by the linear displacement transducer 424.

These measurements (for example, pressure and temperature, as well as volume) provide information about wellbore fluid properties such as pseudo-compressibility and heating capacity. The heating capacity and thermal conductivity of the wellbore fluid 122 can also be estimated by plotting the fluid temperature increase (that is, temperature rise in the sample of the wellbore fluid 122 in the fluid chamber 410) for a given amount of supplied thermal energy (that is, amount of electrical heat output by the heating element 412) and by measuring a time duration for heat propagation between two different locations within the PT cell 408. For example, additional temperature sensors 406 may be positioned in the test chamber 410 near the heating element 412 to increase the accuracy of such measurements.

In some examples, such properties can be empirically correlated with surface conducted experiments that mix the wellbore fluid 122 with various known percentages and types of hydrocarbons (for example, methanol, ethanol, or otherwise) leading to look-ahead fluid typing. For example, by correlating measured properties (for example, pressure, temperature, and volume) of the wellbore fluid 122 in the annulus 110 with pre-determined properties of known compositions that include a gas, an operator may be able to determine a composition of the wellbore fluid 122 during a drilling process.

In some aspects, a pressure build-up ratio of a free gas in the wellbore fluid 122 may be slower than that of a wellbore fluid that contains dissolved gas. Such measureable information may be useful for determining an actual (for example, in situ downhole) fluid density or pseudo-density. For example, inference of the fluid gas content from the measured compressibility and knowledge of an original fluid density (when the fluid is gas-free and almost incompressible) may be used calculate a value for the "gas-rich" fluid density. A borehole fluid pseudo-density profile may therefore be generated using the fluid density values.

Pressure, temperature, and volumetric measurements may be made with the PT cell 408 periodically, at particular moments, in an event-driven manner, or as needed during a wellbore operation (for example, a drilling operation). Several volumes of samples of wellbore fluid 122 may be circulated into the test chamber 410 as needed to measure such properties, at similar or different temperatures. For example, during a measurement process, the valves 418 may be commanded by valve control 420 to remain closed (regardless of the operation of the plunger valve assembly 428 and centrifugal switch assembly 436), thus enclosing the sample in the test chamber 410.

In some examples, measurements may be concluded after the internal pressure of the test chamber 410 has stabilized (for example, remains relatively constant for instance, by increasing or decreasing at a rate of change specified by the operator in psi/min). Once the measurements are concluded, the fluid sample of the wellbore fluid 122 may then be released by commanding the valves 418 to open with valve control 420. Upon opening of the valves 418 (or one of the valves 418), the floating piston 407 is urged (for example, by spring 414) to a neutral position as the internal pressure of the test chamber 410 adjusts to match a pressure in the annulus 110. When desired or scheduled or activated by an event, the valve(s) 418 may be opened by valve control 420 and a new sample of the wellbore fluid 122 may be circulated into the test chamber 410.

Measurements may also cease, for example, when the drilling operation is stopped (that is, when the drill string stops rotating), thereby removing the so-called centrifugal force from the switch blocks 438. The springs 430 inside the plunger valve assembly 428 urge the plunger stems 432 down to fluidly decouple the test chamber 408 from the annulus 110, while the switch springs 440 urge the blocks 438 radially inward toward the fluid test chamber 408. By moving the plunger stems 432 upward, O-rings (shown by circles on either side of the plunger stems 432) fluidly seal the fluid ports 416 to the annulus 110. If further tests are not needed, the valves 418 may be opened to allow the circulation of the wellbore fluid 122 through the PT cell 410.

Figure 5:
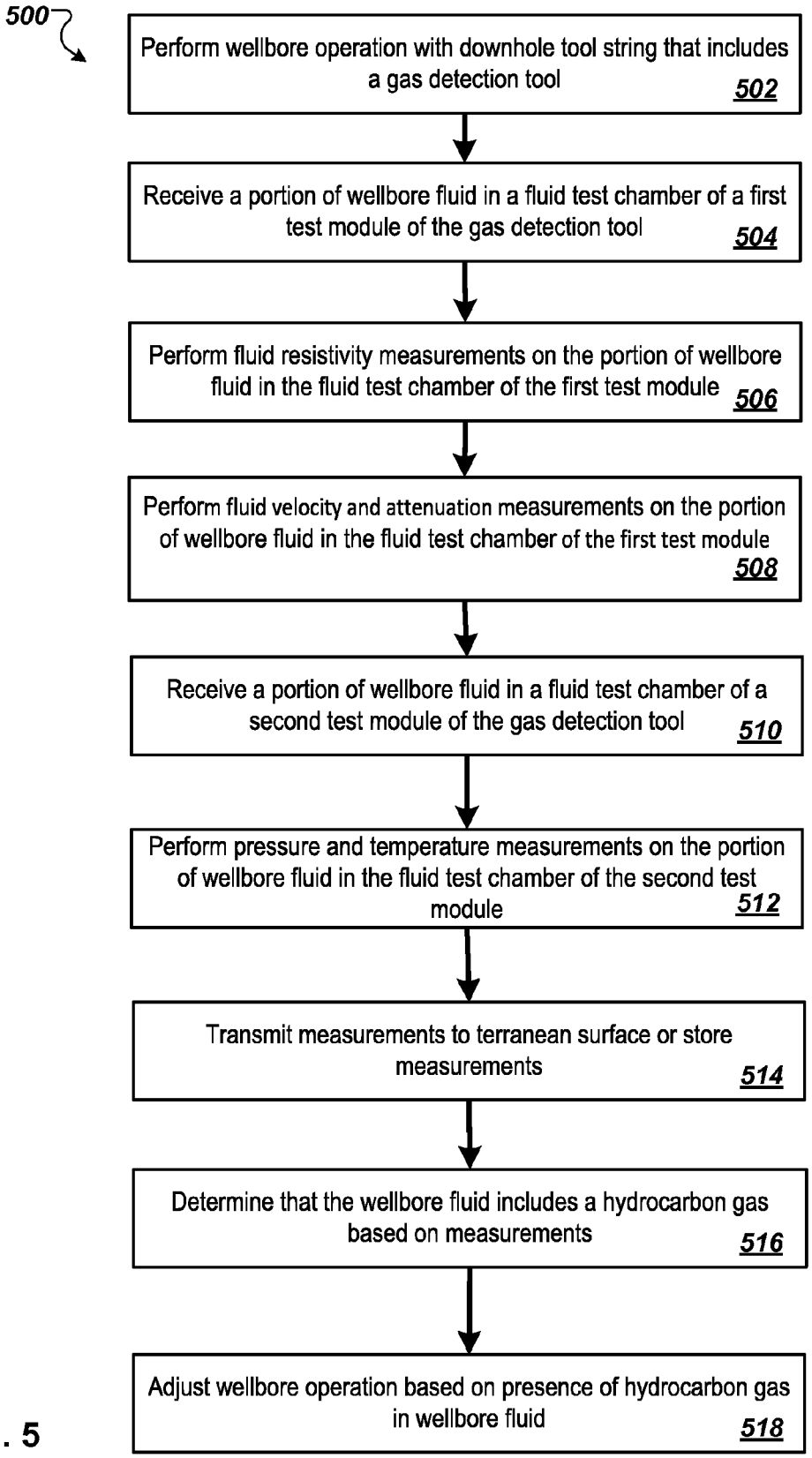
FIG. 5 is a flowchart that illustrates an example operation of a gas detection tool.

FIG. 5 is a flowchart 500 that illustrates an example operation of a gas detection tool, such as, for example, gas detection tool 116 in well system 100 that includes a first and a second testing module according to the present disclosure.

Method 500 may begin at step 502, which includes performing a wellbore operation with a downhole tool string that includes a gas detection tool. In some aspects, the wellbore operation is a drilling operation, and the gas detection tool may be coupled within a tool string (for example, on a tubular drill pipe string) that include, among other components, a drilling bit. The drilling operation includes, for example, rotating the drilling string to operate the drill bit to create the wellbore. A space between the drilling string and a wellbore wall is an annulus, through which a drilling fluid may be circulated from the drill string and back to a terranean surface. The gas detection tool may be coupled within the drilling string uphole of the drilling bit to perform gas detection measurements.

Method 500 continues at step 504, which includes receiving a portion of wellbore fluid (that is, drilling fluid in this example) into a fluid test chamber of a first test module of the gas detection tool. In some implementations, the first test module may include a circulation control system that may controllably receive the portion of the wellbore fluid into the test chamber. For example, one or more powered valves may be adjusted to fluidly couple the test chamber to the annulus to receive the portion of the wellbore fluid into the chamber. Once received, the one or more valves may be controllably adjusted to seal the test chamber to the annulus, thereby sealing the portion of wellbore fluid in the test chamber of the first test module.

As another example, the fluid test chamber may be fluidly coupled to the annulus throughout the wellbore operation, with a filter or other screening mechanism used to filter particulate from the portion of the wellbore fluid. As another example, a centrifugal switch assembly and plunger valve assembly, as described previously with reference to FIG. 3, may fluidly couple the test chamber to the annulus only during operation (for example, rotation) of the drilling string). One or more controllable valves may also be used with a centrifugal switch assembly and plunger valve assembly.

Method 500 continues at step 506, which includes performing fluid resistivity measurements on the portion of wellbore fluid in the fluid test chamber of the first test module. For example, as illustrated in FIGS. 2A-2B and 3, the first test module includes a resistivity cell that measures fluid resistivity of the portion of the wellbore fluid in the test chamber of the first test module. In some aspects, multiple resistivity measurements (for example, of the same portion of wellbore fluid or different portions of wellbore fluid) may be taken and averaged according to a pre-determined schedule (for example, one measurement per minute or otherwise). The average value may be representative of the fluid resistivity of the wellbore fluid for a particular depth or location of the wellbore or for a particular instant or time duration of the wellbore operation. Further, standard deviations of the measurements may be determined.

Method 500 continues at step 508, which includes performing fluid acoustic velocity and attenuation measurements on the portion of wellbore fluid in the fluid test chamber of the first test module. For example, as illustrated in FIGS. 2A-2B and 3, the first test module includes an acoustic transducer that measures fluid acoustic velocity and attenuation of the portion of the wellbore fluid in the test chamber of the first test module. In some aspects, multiple fluid velocity and attenuation measurements (for example, of the same portion of wellbore fluid or different portions of wellbore fluid) may be taken and averaged according to a pre-determined schedule (for example, one measurement per minute or otherwise). The average values may be representative of the acoustic velocity attenuation of the wellbore fluid for a particular depth or location of the wellbore or for a particular instant or time duration of the wellbore operation. As described previously, in some aspects, the fluid resistivity and fluid velocity and attenuation measurements made may be performed on a single portion of wellbore fluid enclosed within a common fluid test chamber of the first test module.

Method 500 continues at step 510, which includes receiving a portion of wellbore fluid (that is, drilling fluid in this example) into a fluid test chamber of a second test module of the gas detection tool. In some implementations, the second test module may include a circulation control system that may controllably receive the portion of the wellbore fluid into the test chamber. For example, one or more powered valves may be adjusted to fluidly couple the test chamber to the annulus to receive the portion of the wellbore fluid into the chamber. Once received, the one or more valves may be controllably adjusted to seal the test chamber to the annulus, thereby sealing the portion of wellbore fluid in the test chamber of the first test module.

As another example, a centrifugal switch assembly and plunger valve assembly, as described previously with reference to FIG. 4, may fluidly couple the test chamber to the annulus only during operation (for example, rotation) of the drilling string). One or more controllable valves may also be used with a centrifugal switch assembly and plunger valve assembly.

Figure 6:
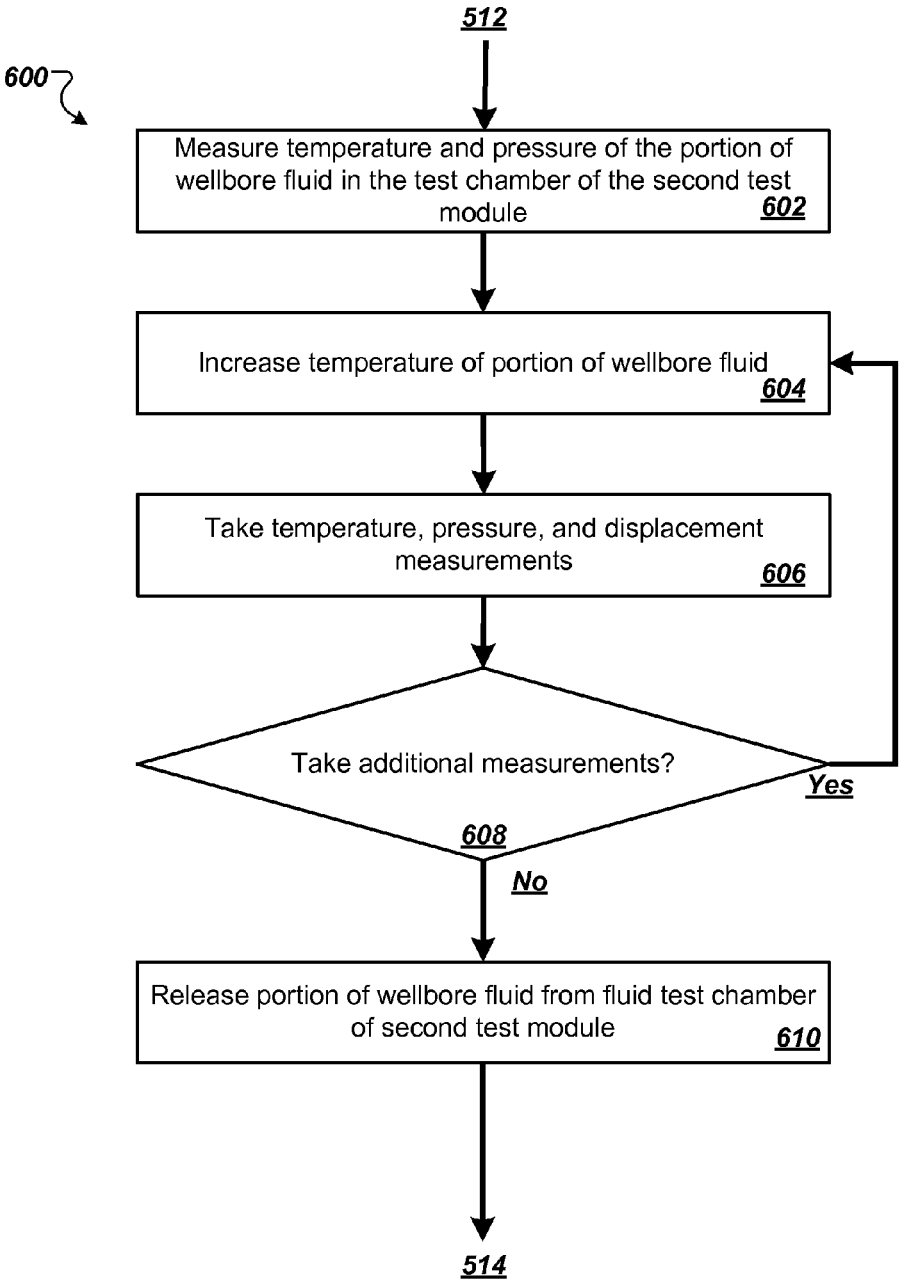
FIG. 6 is a flowchart that illustrates a portion of an example operation of a gas detection tool.

Method 500 continues at step 512, which includes performing pressure and temperature measurements on the portion of wellbore fluid in the fluid test chamber of the second test module. The pressure and temperature measurements may be taken at a specified time interval or upon instruction (for example, by a control system on the terranean surface or in the gas detection tool). Step 512 may include one or more sub-steps as illustrated in method 600 shown in FIG. 6. For example, method 600 may begin at step 602, which includes measuring a temperature and a pressure of the portion of wellbore fluid in the test chamber of the second test module (for example, as described above with respect to FIG. 4). In step 604, a temperature of the portion of the wellbore fluid is increased. For example, as described with respect to FIG. 4, a heating element may be positioned in the second test module in thermally conductive communication with the portion of the wellbore fluid enclosed in the fluid test chamber of the second test module. The heater may be operated to increase the temperature a particular range, for example, between 10° C. and 50° C.

Method 600 may continue at step 606, which includes taking temperature, pressure, and, in some examples, displacement measurements, as the temperature of the wellbore fluid portion is increasing. For example, at particular specified temperature rises (for example, every 1° C., 2° C., 5° C., or otherwise) within the range, the pressure of the fluid test chamber of the second test module may be measured as described with reference to FIG. 4. Further, in some aspects, as described with reference to FIG. 4, the fluid test chamber of the second test module may include a floating piston that defines a wall of the chamber and may move in response to expansion of the portion of the wellbore fluid in the chamber (for example, due to heating). As the wellbore fluid expands in the fluid test chamber, the floating piston is adjusted, and a displacement distance in which the piston moves is measured (for example, relative to a start position).

Method 500 continues at step 508, which includes a determination of whether to take additional measurements (for example, temperature, pressure, displacement, or otherwise). For example, as explained previously, the wellbore fluid enclosed in the fluid test chamber of the second test module may be heated from an initial temperature to a specified or predetermined final temperature (for example, a range between 100° C. and 150° C.). If, for example, the temperature of the wellbore fluid is not at the specified or predetermined final temperature (or a differential temperature of the wellbore fluid relative to an initial temperature is not met), then method 600 may loop back to step 604.

If the temperature of the wellbore fluid is at the specified or predetermined final temperature (or a differential temperature of the wellbore fluid relative to an initial temperature is met), then method 600 may continue at step 610, which includes releasing the portion of wellbore fluid from the fluid test chamber of second test module back to the annulus (for example, by opening one or more valves).

Returning to method 500, step 514 includes transmitting measurements to a terranean surface or storing measurements taken by the gas detection tool. For example, measurements of fluid resistivity, fluid velocity, temperature, pressure, and displacement may be stored in the gas detection tool for later transmission (for example, to control system 125) or may be communicated (for example, through conveyance 130) to the control system 125 at the terranean surface. In some aspects, each measurement may be communicated in real-time (for example, after the measurement is taken without delay or with negligible delay) to the control system 125. In some aspects, measurements taken in a particular cycle (for example, in a particular time duration or once a specified amount of measured data in bits is collected) are then communicated to the control system 125.

In some aspects, the gas detection tool 116 (or control system 125) may perform one or more calculations on the measured data (for example, fluid resistivity, fluid acoustic velocity, and attenuation, temperature, pressure, and displacement) in preparation for displaying such measured data to a well system operator. For example, the gas detection tool 116 or control system 125 may determine a ratio, R, of pressure change of the wellbore fluid to temperature change of the wellbore fluid after each of two consecutive pressure and temperature measurements (in steps 602-606) according to:

$$R = \frac{P_{i+1} - P_i}{T_{i+1} - T_i}, \quad \text{(Eq. 1)}$$

where P is pressure of the fluid test chamber of the second test module, T is temperature of the wellbore fluid in the fluid test chamber of the second test module, and i represents a particular measurement of multiple measurements and may have a range of 1 to X (where X is adjustable to the number of desired measurements, that is the number of completions of step 606).

Method 500 may continue at step 516, which includes determining that the wellbore fluid includes a hydrocarbon gas based on the measurements (for example, at least one of the pressure, temperature, fluid resistivity, or fluid acoustic velocity and attenuation measurements). In some aspects, step 516 may also include determining that the wellbore fluid includes a hydrocarbon gas based on calculations of other criteria based on one or more of the measurements. For example, the ratio of pressure change of the wellbore fluid to temperature change of the wellbore fluid after each of two consecutive pressure and temperature measurements may indicate, for example, a presence or lack of gas in the wellbore fluid. For example, as this ratio increases, there may be an increasing amount of gas in the wellbore fluid.

Further, fluid resistivity and fluid acoustic velocity and attenuation measurements (taken in steps 506 and 508) may also indicate the presence of gas in the wellbore fluid. For example, the presence of gas in the wellbore fluid may be predicted by fluid velocity measurements that indicate a high travel time (of the acoustic signal through the wellbore fluid portion) and/or high amplitude attenuation, absent signal returns, irregular or erratic fluid travel time measurements, low maximum amplitudes of return signals, or other criteria. In addition, the presence of gas in the wellbore fluid may be predicted by fluid resistivity measurements that indicate an increased or erratic resistivity measurements, or both.

Method 500 may continue at step 516, which includes adjusting the wellbore operation (for example, drilling operation) based, at least in part, on the detected presence of hydrocarbon gas in the wellbore fluid. For example, the location or geo-steering of a drill bit used in the wellbore operation may be adjusted. As another example, a type, composition, weight, or otherwise of the wellbore fluid (for example, drilling fluid) may be adjusted based on the detected presence of gas. In some cases, the wellbore operation may be delayed or halted based on the detected presence of gas, where typically the mud (drilling fluid) weight is increased to prevent a well blow-out.

For example, a blow-out may be defined as an unwanted surge (escape) of gas or well fluids (or both) driven by highly-pressurized gas that escaped from the rock formation into the drilling fluid. In other circumstances, the mud weight may be decreased, based on the measured pseudo-compressibility, in order to reduce the stress placed by the weight of the drilling fluid on the rocks which ultimately may cause their failure through (unwanted) fracturing and consequently drilling fluid losses. Fluid losses may also lead to a well blow-out as the loss may reduce the pressure over other zones crossed by the borehole that may be at certain depths at a higher pressure than the pressure provided by the drilling fluid, as the borehole drilling fluid volume decreases as it flows into fractured zones. This may become uncontrollable if the loss-rate exceeds the flow capacity of the fluid injection pumps or the amount of stored fluid in the "mud tanks" (for example, fluid storage containers). Drilling an oil or gas well using optimized fluid weights also benefits the reservoir and is in some cases one of the most critical procedures that affect the reservoir production performance. Characterizing the drilling fluid pseudo-compressibility against its weight (for example, density in grams/cc) may be made possible with apparatus, systems, and methods according to the present disclosure.

A number of implementations have been described. Nevertheless, it will be understood that various modifications may be made without departing from the spirit and scope of the disclosure. For example, example operations, methods, and/or processes described herein may include more steps or fewer steps than those described. Further, the steps in such example operations, methods, or processes may be performed in different successions than that described or illustrated in the figures. In addition, steps may be performed sequentially or simultaneously, and may be repeated. Accordingly, other implementations are within the scope of the following claims. For example, in some aspects, wellbore fluid may be reasonably homogeneous across a depth interval that spans measurement modules as described herein. In some aspects, a valve could be installed between fluid test chambers of the ultrasonic and resistivity module and the PT module. Further, a "wiping piston" mechanism could be installed between the fluid test chambers. By actuating the wiping piston, opening the valve, and closing a path between the PT module fluid chamber and the wellbore, the tested wellbore fluid of the PT fluid chamber could be forced to flow into the fluid chamber of the acoustic and resistivity module for further testing. The valve could be actuated opened or closed as required by the action of the wiping pistons so as to provide a single communication path to expel the fluid content driven out by the piston from one fluid chamber to the other fluid chamber. Accordingly, other implementations are within the scope of the following claims.

What is claimed is:

1. A downhole gas detection tool, comprising:

a housing that comprises a connection configured to couple the tool with a drilling string;

a first test module at least partially enclosed within the housing, the first test module comprising a first fluid test chamber operable to fluidly couple to an annulus of a wellbore to receive a first portion of a wellbore fluid, the first test module further comprising an acoustic fluid sensor to measure a fluid acoustic velocity and attenuation of the first portion of the wellbore fluid received in the first fluid test chamber, and a fluid resistivity sensor to measure a fluid resistivity of the first portion of the wellbore fluid received in the first fluid test chamber, the first test module comprising a target for the acoustic fluid sensor positioned on a side of the first fluid test chamber opposite the acoustic fluid sensor; and a second test module at least partially enclosed within the housing, the second test module comprising a second fluid test chamber operable to fluidly couple to the annulus of the wellbore to receive a second portion of the wellbore fluid, the second test module further comprising a pressure-temperature (PT) sensor to measure at least one of a pressure or a temperature of the second portion of the wellbore fluid received in the second fluid test chamber.

2. The downhole gas detection tool of claim 1, wherein the target comprises a portion of the fluid resistivity sensor.

3. The downhole gas detection tool of claim 1, wherein the first test module further comprises a controllable valve in fluid communication with the first fluid test chamber to controllably receive the first portion of the wellbore fluid into the first fluid test chamber, the controllable valve positioned in a fluid pathway that extends between the first fluid test chamber and the housing.

4. The downhole gas detection tool of claim 3, wherein the first test module further comprises a plunger valve, controllable by a centrifugal switch, and positioned to fluidly couple and fluidly decouple the annulus and the controllable valve in the first test module.

5. The downhole gas detection tool of claim 4, wherein the centrifugal switch is operable to adjust the plunger valve between an open position to fluidly couple the annulus and the controllable valve and a closed position to fluidly decouple the annulus and the controllable valve based on rotation of the drilling string.

6. The downhole gas detection tool of claim 1, wherein the first test module further comprises a pressure compensation module positioned in the housing adjacent the acoustic fluid sensor, the pressure compensation module comprising a pressure compensation piston operable to adjust a differential pressure across the acoustic fluid sensor.

7. The downhole gas detection tool of claim 1, wherein the second test module further comprises a controllable valve in fluid communication with the second fluid test chamber to controllably receive the second portion of the wellbore fluid into the second fluid test chamber, the controllable valve positioned in a fluid pathway that extends between the second fluid test chamber and the housing.

8. The downhole gas detection tool of claim 7, wherein the second test module further comprises a plunger valve, controllable by a centrifugal switch, and positioned to fluidly couple and fluidly decouple the annulus and the controllable valve in the second test module.

9. The downhole gas detection tool of claim 8, wherein the centrifugal switch is operable to adjust the plunger valve between an open position to fluidly couple the annulus and the controllable valve and a closed position to fluidly decouple the annulus and the controllable valve based on rotation of the drilling string.

10. The downhole gas detection tool of claim 1, wherein the second test module further comprises a floating piston positioned in the second fluid test chamber and moveable within the second fluid test chamber based on a pressure of the second portion of the wellbore fluid.

11. The downhole gas detection tool of claim 10, wherein the second test module further comprises a heater positioned to transfer heat to the second portion of the wellbore fluid.

12. The downhole gas detection tool of claim 10, wherein the second test module further comprises a displacement measurement sensor positioned to measure a displacement distance of the floating piston based on the pressure of the second portion of the wellbore fluid.

13. The downhole gas detection tool of claim 1, wherein the wellbore fluid comprises a drilling fluid.

14. A method for detecting gas in a wellbore fluid, comprising:

receiving a first portion of wellbore fluid in a first fluid test chamber of a first test module of the gas detection tool coupled within a downhole tool string in a wellbore;

measuring a fluid resistivity of the first portion of wellbore fluid in the first fluid test chamber of the first test module;

measuring a fluid acoustic velocity and fluid acoustic attenuation of the first portion of wellbore fluid in the first fluid test chamber of the first test module;

receiving a second portion of wellbore fluid in a second fluid test chamber of a second test module of the gas detection tool;

measuring at least one of a pressure or a temperature of the second portion of wellbore fluid in the second test chamber of the second test module; and determining a presence of a hydrocarbon gas in the wellbore fluid based on at least one of the measured fluid resistivity, fluid acoustic velocity, fluid acoustic attenuation, pressure, or temperature.

15. The method of claim 14, further comprising drilling the wellbore with the downhole tool string.

16. The method of claim 14, wherein receiving the first portion of wellbore fluid in the first fluid test chamber of the first test module of the gas detection tool comprises:

opening a control valve positioned in a fluid pathway that extends between the first fluid test chamber and an exterior housing of the gas detection tool; and fluidly coupling an annulus of the wellbore with the first fluid test chamber based on opening the valve.

17. The method of claim 16, further comprising:

rotating the downhole tool string in the wellbore;

based on the rotation, opening a plunger valve positioned in the fluid pathway with a centrifugal switch; and fluidly coupling the annulus of the wellbore with the control valve.

18. The method of claim 14, wherein receiving the second portion of wellbore fluid in the second fluid test chamber of the second test module of the gas detection tool comprises:

opening a control valve positioned in a fluid pathway that extends between the second fluid test chamber and an exterior housing of the gas detection tool;

fluidly coupling an annulus of the wellbore with the second fluid test chamber based on opening the control valve to receive the second portion of wellbore fluid in the second fluid test chamber; and closing the control valve to seal the second portion of the wellbore fluid in the second fluid test chamber.

19. The method of claim 18, further comprising:

rotating the downhole tool string in the wellbore;

based on the rotation, opening a plunger valve positioned in the fluid pathway with a centrifugal switch; and fluidly coupling the annulus of the wellbore with the control valve.

20. The method of claim 14, further comprising at least one of:

transmitting the at least one measured fluid resistivity, fluid acoustic velocity, fluid acoustic attenuation, pressure, or temperature from the gas detection tool to a control system located on a terranean surface; or storing the at least one measured fluid resistivity, fluid acoustic velocity, fluid acoustic attenuation, pressure, or temperature in the gas detection tool.

21. The method of claim 14, wherein measuring at least one of the pressure or the temperature of the second portion of wellbore fluid in the second test chamber of the second test module comprises:

measuring an initial temperature and an initial pressure of the second portion of the wellbore fluid;

heating the second portion of the wellbore fluid a first specified temperature increase; and measuring, after the heating, a second temperature and a second pressure of the second portion of the wellbore fluid.

22. The method of claim 21, further comprising:

determining a ratio of a pressure differential to a temperature differential of the second portion of the wellbore fluid, the pressure differential comprising a difference between the subsequent pressure and the initial pressure, the temperature differential comprising a difference between the subsequent temperature and the initial temperature; and determining the presence of the hydrocarbon gas in the wellbore fluid based at least in part on the determined ratio.

23. The method of claim 21, further comprising:

determining that the second portion of wellbore fluid is at a threshold temperature; and based on the determination, releasing the second portion of wellbore fluid from the second fluid test chamber to the annulus.

24. The method of claim 14, further comprising: based on the determined presence of the hydrocarbon gas in the wellbore fluid, adjusting an operational parameter of the downhole tool string.

25. The method of claim 24, wherein adjusting the operational parameter of the downhole tool string comprises at least one of:

adjusting a rate of penetration of a drill bit of the downhole tool string; or adjusting a geo-direction of the drill bit of the downhole tool string.

26. A well system, comprising:

a drilling string that comprises a downhole gas detection tool, the tool comprising:

an acoustic fluid sensor positioned adjacent a first fluid chamber;

a fluid resistivity sensor positioned adjacent the first fluid chamber; and a pressure-temperature (PT) sensor positioned adjacent a second fluid chamber; and a control system communicably coupled to the gas detection tool and operable to perform operations comprising:

operating a first valve during a drilling operation of the drilling string to circulate a drilling fluid into the first fluid chamber;

operating a second valve during the drilling operation of the drilling string to circulate the drilling fluid into the second fluid chamber;

receiving a measurement of at least one of a fluid acoustic velocity, fluid acoustic attenuation, a fluid resistivity, a fluid temperature, or a fluid pressure from the downhole gas detection tool;

determining a presence of a hydrocarbon gas in the drilling fluid based on the received measurement;

after receiving a measurement of the fluid temperature and the fluid pressure, operating a heater to heat the drilling fluid in the second fluid chamber;

after heating, receiving another measurement of the fluid temperature and the fluid pressure; and determining a ratio of a fluid temperature differential to a fluid pressure differential based on the measurements of the fluid temperature and the fluid pressure.

27. The well system of claim 26, wherein the control system is operable to perform further operations comprising:

receiving a measurement of a displacement distance of a floating piston in the second fluid chamber based on an increase in the fluid pressure of the drilling fluid in the second fluid chamber; and determining the presence of the hydrocarbon gas in the drilling fluid based on the received measurement of the displacement distance.

28. The well system of claim 26, wherein the control system is operable to perform further operations comprising:

based on a determination that the fluid pressure differential exceeds a threshold pressure differential, operating at least one pressure compensation piston to adjust a pressure of a pressure compensation chamber adjacent the acoustic fluid sensor to reduce the fluid pressure differential.

29. The well system of claim 26, wherein the control system is operable to perform further operations comprising operating the first and second control valves to release the drilling fluid from the first and second fluid chambers to the annulus.

30. A downhole gas detection tool, comprising:

a housing that comprises a connection configured to couple the tool with a drilling string;

a first test module at least partially enclosed within the housing, the first test module comprising a first fluid test chamber operable to fluidly couple to an annulus of a wellbore to receive a first portion of a wellbore fluid, the first test module further comprising an acoustic fluid sensor to measure a fluid acoustic velocity and attenuation of the first portion of the wellbore fluid received in the first fluid test chamber, and a fluid resistivity sensor to measure a fluid resistivity of the first portion of the wellbore fluid received in the first fluid test chamber, the first test module comprising a controllable valve in fluid communication with the first fluid test chamber to controllably receive the first portion of the wellbore fluid into the first fluid test chamber, the controllable valve positioned in a fluid pathway that extends between the first fluid test chamber and the housing; and a second test module at least partially enclosed within the housing, the second test module comprising a second fluid test chamber operable to fluidly couple to the annulus of the wellbore to receive a second portion of the wellbore fluid, the second test module further comprising a pressure-temperature (PT) sensor to measure at least one of a pressure or a temperature of the second portion of the wellbore fluid received in the second fluid test chamber.

31. A downhole gas detection tool, comprising:

a housing that comprises a connection configured to couple the tool with a drilling string;

a first test module at least partially enclosed within the housing, the first test module comprising a first fluid test chamber operable to fluidly couple to an annulus of a wellbore to receive a first portion of a wellbore fluid, the first test module further comprising an acoustic fluid sensor to measure a fluid acoustic velocity and attenuation of the first portion of the wellbore fluid received in the first fluid test chamber, and a fluid resistivity sensor to measure a fluid resistivity of the first portion of the wellbore fluid received in the first fluid test chamber, the first test module comprising a pressure compensation module positioned in the housing adjacent the acoustic fluid sensor, the pressure compensation module comprising a pressure compensation piston operable to adjust a differential pressure across the acoustic fluid sensor; and a second test module at least partially enclosed within the housing, the second test module comprising a second fluid test chamber operable to fluidly couple to the annulus of the wellbore to receive a second portion of the wellbore fluid, the second test module further comprising a pressure-temperature (PT) sensor to measure at least one of a pressure or a temperature of the second portion of the wellbore fluid received in the second fluid test chamber.

32. A downhole gas detection tool, comprising:

a housing that comprises a connection configured to couple the tool with a drilling string;

a first test module at least partially enclosed within the housing, the first test module comprising a first fluid test chamber operable to fluidly couple to an annulus of a wellbore to receive a first portion of a wellbore fluid, the first test module further comprising an acoustic fluid sensor to measure a fluid acoustic velocity and attenuation of the first portion of the wellbore fluid received in the first fluid test chamber, and a fluid resistivity sensor to measure a fluid resistivity of the first portion of the wellbore fluid received in the first fluid test chamber; and a second test module at least partially enclosed within the housing, the second test module comprising a second fluid test chamber operable to fluidly couple to the annulus of the wellbore to receive a second portion of the wellbore fluid, the second test module further comprising a pressure-temperature (PT) sensor to measure at least one of a pressure or a temperature of the second portion of the wellbore fluid received in the second fluid test chamber, the second test module comprising a controllable valve in fluid communication with the second fluid test chamber to controllably receive the second portion of the wellbore fluid into the second fluid test chamber, the controllable valve positioned in a fluid pathway that extends between the second fluid test chamber and the housing.

33. A downhole gas detection tool, comprising:

a housing that comprises a connection configured to couple the tool with a drilling string;

a first test module at least partially enclosed within the housing, the first test module comprising a first fluid test chamber operable to fluidly couple to an annulus of a wellbore to receive a first portion of a wellbore fluid, the first test module further comprising an acoustic fluid sensor to measure a fluid acoustic velocity and attenuation of the first portion of the wellbore fluid received in the first fluid test chamber, and a fluid resistivity sensor to measure a fluid resistivity of the first portion of the wellbore fluid received in the first fluid test chamber; and a second test module at least partially enclosed within the housing, the second test module comprising a second fluid test chamber operable to fluidly couple to the annulus of the wellbore to receive a second portion of the wellbore fluid, the second test module further comprising a pressure-temperature (PT) sensor to measure at least one of a pressure or a temperature of the second portion of the wellbore fluid received in the second fluid test chamber, the second test module comprising a floating piston positioned in the second fluid test chamber and moveable within the second fluid test chamber based on a pressure of the second portion of the wellbore fluid.

34. A well system, comprising:

a drilling string that comprises a downhole gas detection tool, the tool comprising:

an acoustic fluid sensor positioned adjacent a first fluid chamber;

a fluid resistivity sensor positioned adjacent the first fluid chamber; and a pressure-temperature (PT) sensor positioned adjacent a second fluid chamber; and a control system communicably coupled to the gas detection tool and operable to perform operations comprising:

operating a first valve during a drilling operation of the drilling string to circulate a drilling fluid into the first fluid chamber;

operating a second valve during the drilling operation of the drilling string to circulate the drilling fluid into the second fluid chamber;

receiving a measurement of at least one of a fluid acoustic velocity, fluid acoustic attenuation, a fluid resistivity, a fluid temperature, or a fluid pressure from the downhole gas detection tool;

determining a presence of a hydrocarbon gas in the drilling fluid based on the received measurement;

receiving a measurement of a displacement distance of a floating piston in the second fluid chamber based on an increase in the fluid pressure of the drilling fluid in the second fluid chamber; and determining the presence of the hydrocarbon gas in the drilling fluid based on the received measurement of the displacement distance.

35. A well system, comprising:

a drilling string that comprises a downhole gas detection tool, the tool comprising:

an acoustic fluid sensor positioned adjacent a first fluid chamber;

a fluid resistivity sensor positioned adjacent the first fluid chamber; and a pressure-temperature (PT) sensor positioned adjacent a second fluid chamber; and a control system communicably coupled to the gas detection tool and operable to perform operations comprising:

operating a first valve during a drilling operation of the drilling string to circulate a drilling fluid into the first fluid chamber;

operating a second valve during the drilling operation of the drilling string to circulate the drilling fluid into the second fluid chamber;

receiving a measurement of at least one of a fluid acoustic velocity, fluid acoustic attenuation, a fluid resistivity, a fluid temperature, a fluid pressure, or a fluid differential pressure from the downhole gas detection tool;

determining a presence of a hydrocarbon gas in the drilling fluid based on the received measurement; and based on a determination that the fluid pressure differential exceeds a threshold pressure differential, operating at least one pressure compensation piston to adjust a pressure of a pressure compensation chamber adjacent the acoustic fluid sensor to reduce the fluid pressure differential.

* * * * *